US007228090B2

(12) United States Patent
Toso et al.

(10) Patent No.: US 7,228,090 B2
(45) Date of Patent: Jun. 5, 2007

(54) IMAGE FORMING APPARATUS WITH A REMOVABLE PROCESS UNIT CAPABLE OF SECURING ROTATION TRANSMISSION ACCURACY WITHOUT STRESSING A HOLDING PORTION DESPITE SHAFT MISALIGNMENT

(75) Inventors: Yoshiyuki Toso, Toyokawa (JP); Nozomu Kondo, Toyokawa (JP); Kou Yamada, Toyohashi (JP); Tooru Watanabe, Toyokawa (JP); Syuichi Katogi, Toyokawa (JP); Shigeru Tashiro, Toyokawa (JP); Tetsuya Kagawa, Aichi-ken (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 118 days.

(21) Appl. No.: 10/980,268

(22) Filed: Nov. 4, 2004

(65) Prior Publication Data

US 2005/0191092 A1 Sep. 1, 2005

(30) Foreign Application Priority Data

Feb. 26, 2004 (JP) ..... 2004-051346
May 6, 2004 (JP) ..... 2004-137187

(51) Int. Cl.
*G03G 21/00* (2006.01)
*G03G 15/00* (2006.01)

(52) U.S. Cl. ..... 399/167

(58) Field of Classification Search ..... None
See application file for complete search history.

(56) References Cited

U.S. PATENT DOCUMENTS 6,035,159 A * 3/2000 Azuma et al. ..... 399/111
6,324,363 B1 11/2001 Watanabe et al.
6,330,409 B1 * 12/2001 Watanabe et al. ..... 399/111
6,397,029 B1 5/2002 Portig

FOREIGN PATENT DOCUMENTS

JP 62-156961 U 10/1987
JP 07-332351 A 12/1995
JP 10-153937 A 6/1998
JP 10-153941 A 6/1998
JP 2000-214646 8/2000

* cited by examiner

*Primary Examiner*—Quana Grainger
(74) *Attorney, Agent, or Firm*—Morrison & Foerster LLP

(57) ABSTRACT

It is intended to provide an image forming apparatus capable of securing rotation transmission accuracy among input/output axes without giving stress to a holding portion despite shaft misalignment and without using material of high strength. A color printer 1 comprises a main body 2 and an image forming unit 30 removable from the main body 2. The main body 2 includes a gear 43 for receiving rotary driving force to the image forming unit 30 and a joint 45 and the image forming unit 30 has a coupling 36 for receiving rotary driving force from the main body 2. Furthermore, a joint holder section 43*a* for the gear 43 and the coupling 36 has a contact hole 47, and contact hole 36*a*, respectively and both ends of the joint 45 are inserted in those holes. The contact holes 47 and 36*a* are in not-twisted triangle pole shape and the joint 45 is in twisted triangle pole shape.

17 Claims, 17 Drawing Sheets

IMAGE FORMING APPARATUS WITH A REMOVABLE PROCESS UNIT CAPABLE OF SECURING ROTATION TRANSMISSION ACCURACY WITHOUT STRESSING A HOLDING PORTION DESPITE SHAFT MISALIGNMENT

This application is based on Applications No. 2004-051346 and No. 2004-137187 filed in Japan, contents of which are hereby incorporated by reference.

BACKGROUND OF THE INVENTION

1. Field of the Invention

The present invention relates to an image forming apparatus such as a printer, a copier, and the like. More particularly, it relates to an image forming apparatus of which process unit including a photosensitive body or an intermediate transfer image belt, or the like is removable.

2. Description of Related Art

There have conventionally been devised image forming apparatuses of which wear-out portion such as photosensitive drum or the like is made in a removable unit so that an end user can replace it with a new one. For example, a tandem type image forming apparatus provided with four image forming sections for respective colors, namely, yellow, magenta, cyan, and black, has four image forming units for the respective colors. In case such an image forming unit is attached to a main body of an image forming apparatus, it is at least required that a photo sensitive drum be driven with rotation. Therefore, the photosensitive drum is connected to a driving power source installed in the main body so that force should be transmitted.

There have conventionally been suggested various structure of a connector section (see JP Laid-open Patent Publication No. 2000-214646and U.S. Pat. No. 6,397,029, for example) JP Laid-open Patent Publication No. 2000-214646 discloses an image forming apparatus which has a coupling axis separated from both a drive gear and a photosensitive drum. Each connector section of the apparatus has a twisted polygon column shaped hole and a twisted polygon column shaped projection. A hole and a projection are coupled and rotation is given to drive, whereby screwing force works on each other and positioning is aligned. Furthermore, U.S. Pat. No. 6,397,029 discloses coupling structure such that plural projections are arranged on an end portion of a universal joint built in a gear, and portions to be connected are coupled with the projections.

However, in the apparatus of above JP Laid-open Patent Publication, a hole and a projection attract each other to meet center of input/output axis like a screw when driving force is transmitted. As a result, stress is given to members for holding input/output axis and a cover box of an image forming apparatus, which causes a fear of distortion. To resolve this problem, accuracy is required to make shaft misalignment of the input/output axis small, or structure to provide tolerance for distortion at its holding section or the like. Structure tolerable to distortion makes an apparatus itself larger and causes cost-up, whereas higher accurate design makes it difficult to attach/remove an image forming unit. As to the coupling structure of above USP, since rotation driving force is applied to projections arranged on an end portion of a universal joint; the universal joint itself must be made of material of which strength is high.

SUMMARY OF THE INVENTION

The present invention has been made in order to solve the foregoing problem. It is an object of the present invention to provide an image forming apparatus capable of securing rotation transmission accuracy between input/output axes without giving stress to a holding portion despite shaft misalignment and without using material of high strength. Furthermore, it is also intended to provide an image forming apparatus capable of securing rotation transmission accuracy with simple structure, of which durability is high and dislocation of a joint is avoided.

According to a first aspect of the present invention, there is provided an image forming apparatus for forming an image attached with a removable process unit, the image forming apparatus comprising: a first driving force transmitting member for receiving rotary driving force to a process unit; and an intermediate driving force transmitting member for receiving rotary driving force from the first driving force transmitting member, the intermediate driving force transmitting member being arranged between the fist driving force transmitting member and a process unit, wherein either the first driving force transmitting member or the intermediate driving force transmitting member has a concave section and other driving force transmitting member has an end section located in the concave section, the end section has three edge sections at its side section, the concave section has contact sections to be in contact with the edge sections at side section, number of the contact sections is three or a multiple of three, the edge sections and the contact sections have different twisting angles, and rotary driving force is transmitted from the intermediate driving force transmitting member to a process unit. A photosensitive body unit and an intermediate transfer unit correspond to a process unit.

According to the first aspect of the present invention, rotary driving force is transmitted to the removable process unit via the first driving force transmitting member and the intermediate driving force transmitting member. Driving force transmission from the first driving force transmitting member to the intermediate driving force transmitting member is made by the contact sections of the concave section for the one of the transmitting members and three edge sections at the end section of the other transmitting member coming to contact with each other. Furthermore, since the edge sections and the contact sections have different twisting angles, there are three contact points, more specifically, one contact point for each of the three edge sections. In case of three-point contact, the center of the three contact points accords with that of the edge sections and the contact sections. Therefore, with contact state, rotation center of the first driving force transmitting member and that of the intermediate driving force transmitting member accord with each other. On the other hand, even if axis center of the first driving force transmitting member and that of the intermediate driving force transmitting member tilt, such tilt does not affect three-point contact and driving force transmission. Accordingly, since shaft misalignment of the first driving force transmitting member and the intermediate driving force transmitting member, which occurs when a process unit is attached, is absorbed by tilt of axis center, stress is never added to theirs holder sections. Thereby, even if centers of the input/output axes are not aligned with each other, stress is never added to theirs holder sections and rotation transmit accuracy between input/output axes can be secured without using material of high hardness.

As to different twisting angles, either the edge sections or the contact sections does not have twisted portion and the other one has twisted portion, for example. In such a case, the edge sections or the contact sections, whichever may have twisted portion. Alternatively, both of the sections may have twisted portions and their twisted angles or twisted direction may be different.

According to a second aspect of the present invention, there is provided an image forming apparatus comprising a main body and a process unit removable from the main body, forming an image attached a removable process unit to the main body, wherein the main body comprises a first driving force transmitting member for receiving rotary driving force to a process unit, the process unit comprises a second driving force transmitting member for receiving rotary driving force from the main body, either the main body or the process unit has an intermediate driving force transmitting member arranged between the first and the second driving force transmitting members, both a driving force transmitting portion between the first driving force transmitting member and the intermediate driving force transmitting member and a driving force transmitting portion between the intermediate driving force transmitting member and the second driving force transmitting member comprise a set of a concave section and an end section located in the concave section, the end section has three edge sections at its side section, the concave section has contact sections to be in contact with the edge sections at side section, number of the contact sections is three or a multiple of three, the edge sections and the contact sections have different twisting angles.

According to the second aspect of the present invention, rotary driving force is transmitted from the first driving force transmitting member to the second driving force transmitting member through the intermediate driving force transmitting member. Driving force transmission among those transmitting members is made by respective edge sections and the contact sections provided at both coupled sections coming to contact with each other at three points. Accordingly, shaft misalignment of the first driving force transmitting member and the intermediate driving force transmitting member or shaft misalignment of the intermediate driving force transmitting member and the second driving force transmitting member, which occurs when a process unit is attached, is absorbed by tilt of those shafts. Thereby, even if centers of the input/output axes are not aligned with each other, stress is never added to their holder sections and rotation transmit accuracy between input/output axes can be secured without using material of high hardness.

According to a third aspect of the present invention, there is provided an image forming apparatus for forming an image attached with a removable process unit, the image forming apparatus comprising: a first driving force transmitting member for receiving rotary driving force to the process unit, the first driving force transmitting member having a concave section of polygon shaped cross section at its process unit side; an intermediate driving force transmitting member of which one end portion is located in the concave section, the intermediate driving force transmitting member receiving rotary driving force from the first driving force transmitting member and transmitting rotary driving force to the process unit, and having a step section of polygon shaped cross section at its side surface; and a displacement stopper section arranged at the concave section and coming to contact with the step section when the intermediate driving force transmitting member escapes from the concave section.

According to the third aspect of the present invention, rotary driving force is transmitted to the process unit by the first driving force transmitting member for receiving rotary driving force to the process unit and the intermediate driving force transmitting member of which one end portion is located in the concave section. Since the intermediate driving force transmitting section has the concave section of polygon shaped cross section at its process unit side and one end of the intermediate driving force transmitting member of polygon shaped is located in its concave section, rotation transmit accuracy between input/output axes can be secured with such simple structure. Furthermore, since the step section of the intermediate driving force transmitting member is in contact with the displacement stopper section, displacement of the intermediate driving force transmitting member does not occur.

According to a fourth aspect of the present invention, there is provided an image forming apparatus comprising a main body and a process unit removable from the main body, forming an image attached a removable process unit to the main body, wherein the main body comprises a first driving force transmitting member for receiving rotary driving force to the process unit, the first driving force transmitting member having a concave section of polygon shaped cross section at its process unit side, the process unit comprises a second driving force transmitting member for receiving rotary driving force from the main body, the second driving force transmitting member having a concave section of polygon shaped cross section at its main body side, and either the main body or the process unit comprises: an intermediate driving force transmitting member of which both ends are located in the concave sections of the first and the second driving force transmitting members, the intermediate driving force transmitting member receiving rotary driving force from the first driving force transmitting member, transmitting rotary driving force to the second driving force transmitting member, and having a step section of polygon shaped cross section at its side wall, and a displacement stopper section arranged at the concave section and coming to contact with the step section when the intermediate driving force transmitting member escapes from the concave section.

According to the fourth aspect of the present invention, the second driving force transmitting member is arranged on the process unit and rotary driving force is transmitted from the first driving force transmitting member to the second driving force transmitting member through the intermediate driving force transmitting member. Both the first and second driving force transmitting members have the concave section of polygon shaped cross section, respectively, and both ends of the intermediate driving force transmitting member are located in those concave sections, rotation transmit accuracy between input/output axes can be secured with such simple structure.

According to a fifth aspect of the present invention, there is provided an image forming apparatus with a removable process unit comprising: a driving member arranged rotatably within the image forming apparatus, the driving member being connected to driving source and having a polygon shape; and a driven member arranged within the removable process unit, the driven member having a concave section in which the driving member is inserted, the concave section having polygon shaped inner surface, wherein rotary driving force is transmitted by contact of edge lines of the driving member and inner surface of the concave section of the driven section, and the edge lines of the driving member and the inner surface of the concave section of the driven member have different twisted angles.

According to a sixth aspect of the present invention, there is provided an image forming apparatus with a removable process unit comprising: a driving member arranged rotatably within the image forming apparatus, the driving member being connected to driving source and having a concave section of polygon shape at its end; and a driven member arranged within the removable process unit, being inserted in the concave section of the driving member, and having polygon shape, wherein rotary driving force is transmitted by contact of edge lines of the driven member and inner surface of the concave section of the driving section, and the edge lines of the driven member and the inner surface of the concave section of the driving member have different twisted angles.

The above and further objects and novel features of the invention will more fully appear from the following detailed description when the same is read n connection with the accompanying drawings. It is to be expressly understood, however, that the drawings are for the purpose of illustration only and are not intended as a definition of the limits of the invention.

BRIEF DESCRIPTION OF DRAWINGS

For a better understanding of the present invention, reference is made to the following detailed description of the invention, just in conjunction with the accompanying drawings in which.

DETAILED DESCRIPTION OF PREFERRED EMBODIMENTS

First Embodiment

There will be described a first embodiment in detail by referring to drawings. In this embodiment, the present invention is applied to a tandem type color printer.

Figure 1:
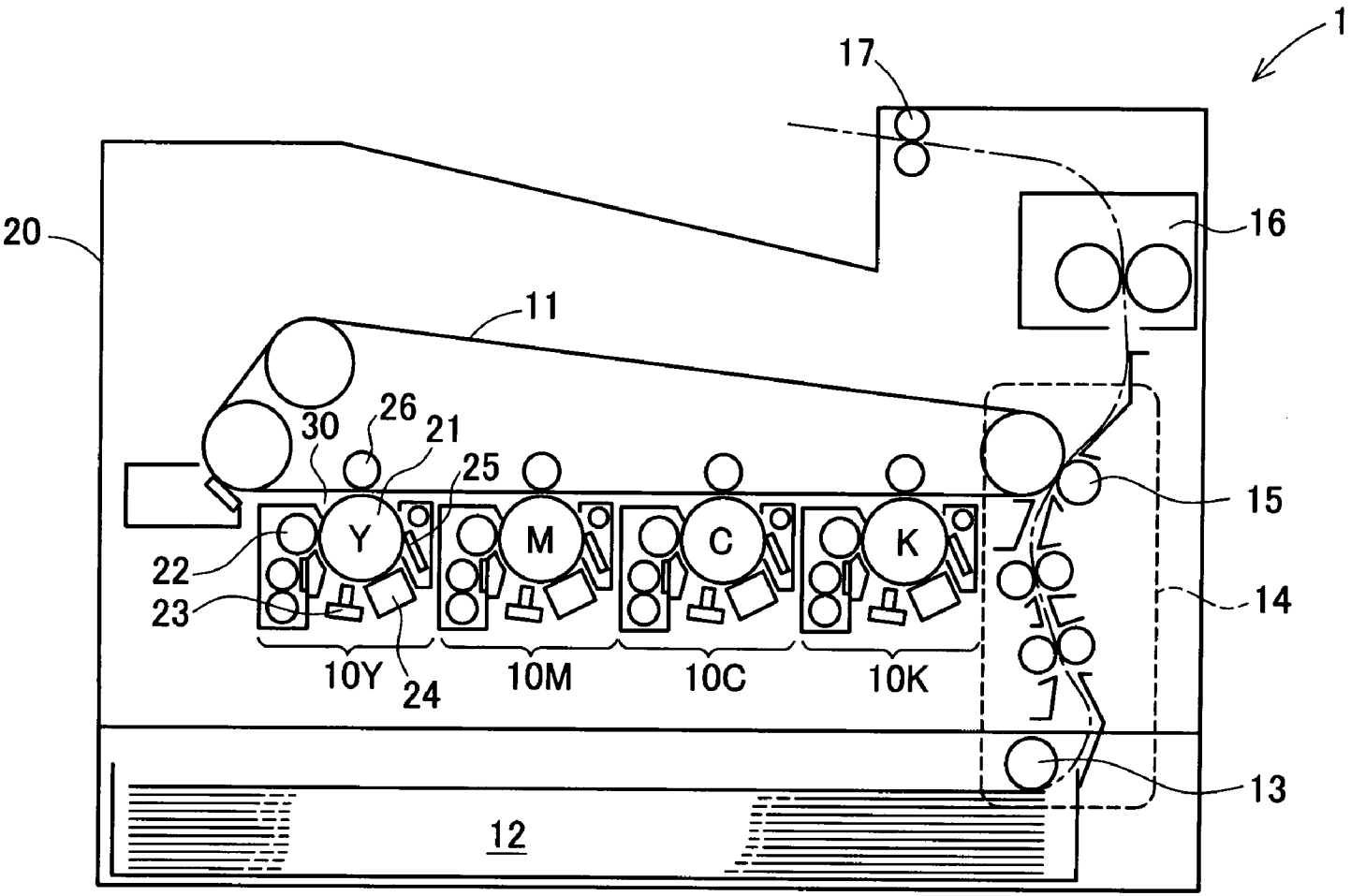
FIG. 1 is a sectional view schematically showing structure of a color printer directed to first and second embodiment.

In a color printer 1 directed to this embodiment, as shown in FIG. 1, image forming sections of respective colors 10Y, 10M, 10C, and 10K are arranged along an intermediate image transfer belt 11. At the bottom portion of the color printer, there is attached a paper cassette 12. Sheets of paper in there are fed to a paper carrying section 14 by a paper feeding roller 13. An image formed on the intermediate image transfer belt 11 by superimposing respective color images through the image forming sections 10Y, 10M, 10C, and 10K is transferred onto a sheet of paper at a secondary image transfer section 15, and fixed at an image fixing section 16. A sheet of paper on which an image is thus formed is ejected by a paper ejecting roller 17. All of the above-mentioned structure is housed in a cover box 20.

Each of the image forming sections 10Y, 10M, 10C, and 10K is structured similarly, constituted by a photosensitive drum 21, a developing section 22, exposure section 23, a charging section 24, a cleaner section 25, and an image transfer section 26. Since structure and operation of the respective composing elements are ordinary type, description will be omitted. As to each of the image forming sections 10Y, 10M, 10C, and 10K, at least on predetermined portion including a photosensitive body 21 is made of a unit, thereby to constitute an image forming unit 30. Image forming units 30 are removable from the cover body 20 of the color printer 1. As a generic name of them, all of the composing elements except image forming units 30 are termed as main body 2.

At the front side of the color printer 1 shown in FIG. 1, there is arranged a movable door. By opening the door 1, an end portion of each image forming unit 30 is exposed at the front side. A user can remove an image forming unit 30 from the main body 2 by holding the exposed end portion and drawing it out forward. Furthermore, the user can attach a new image forming unit 30 by inserting it in a vacant space after former image forming unit 30 is drawn out and pushing the new one inside. After attachment, the user shuts the door, whereby the front-side end portion of the image forming unit 30 is held and fixed by the inner surface of the door.

Figure 2:
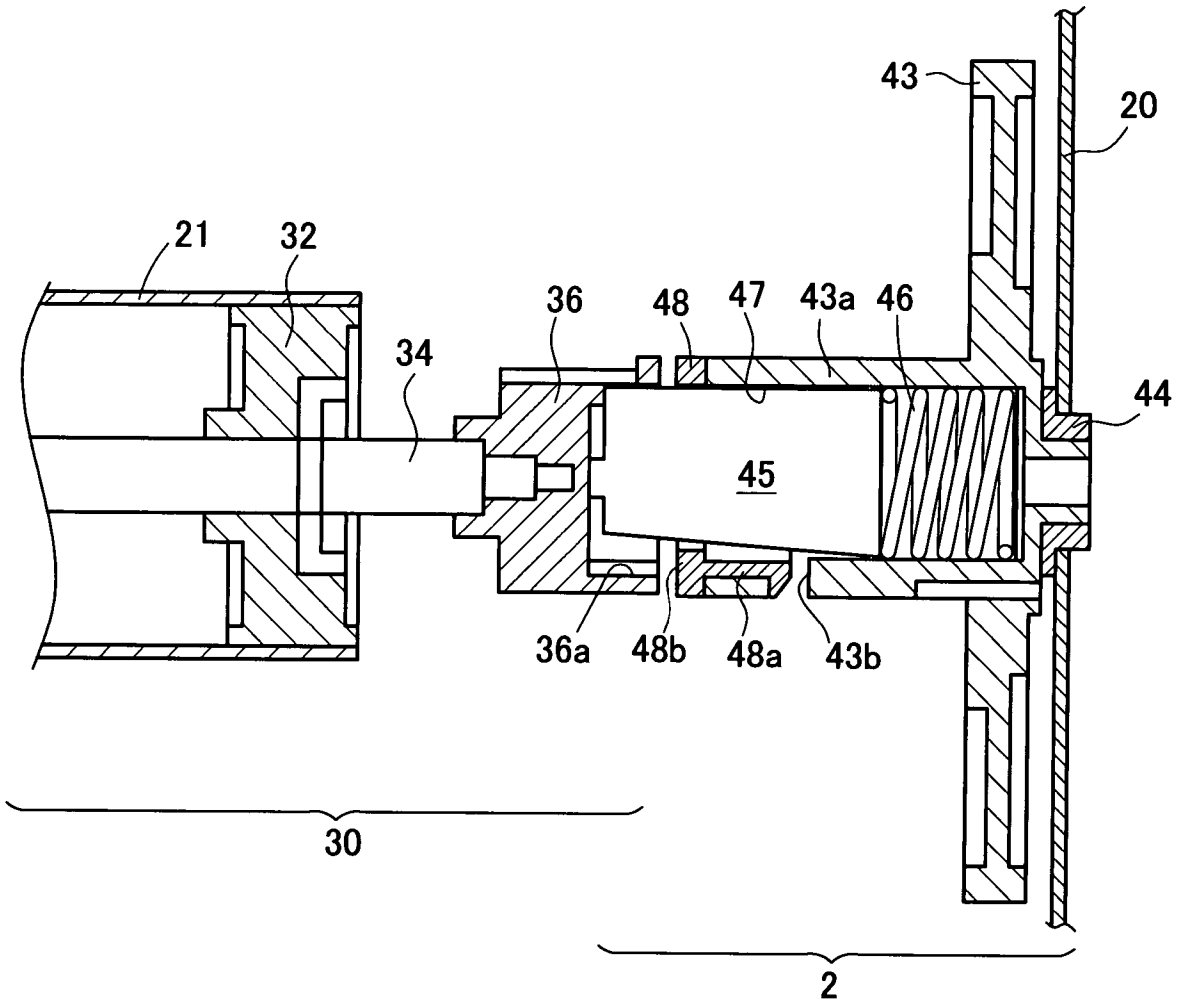
FIG. 2 is a sectional view showing a connector portion directed to the first embodiment.
Figure 3:
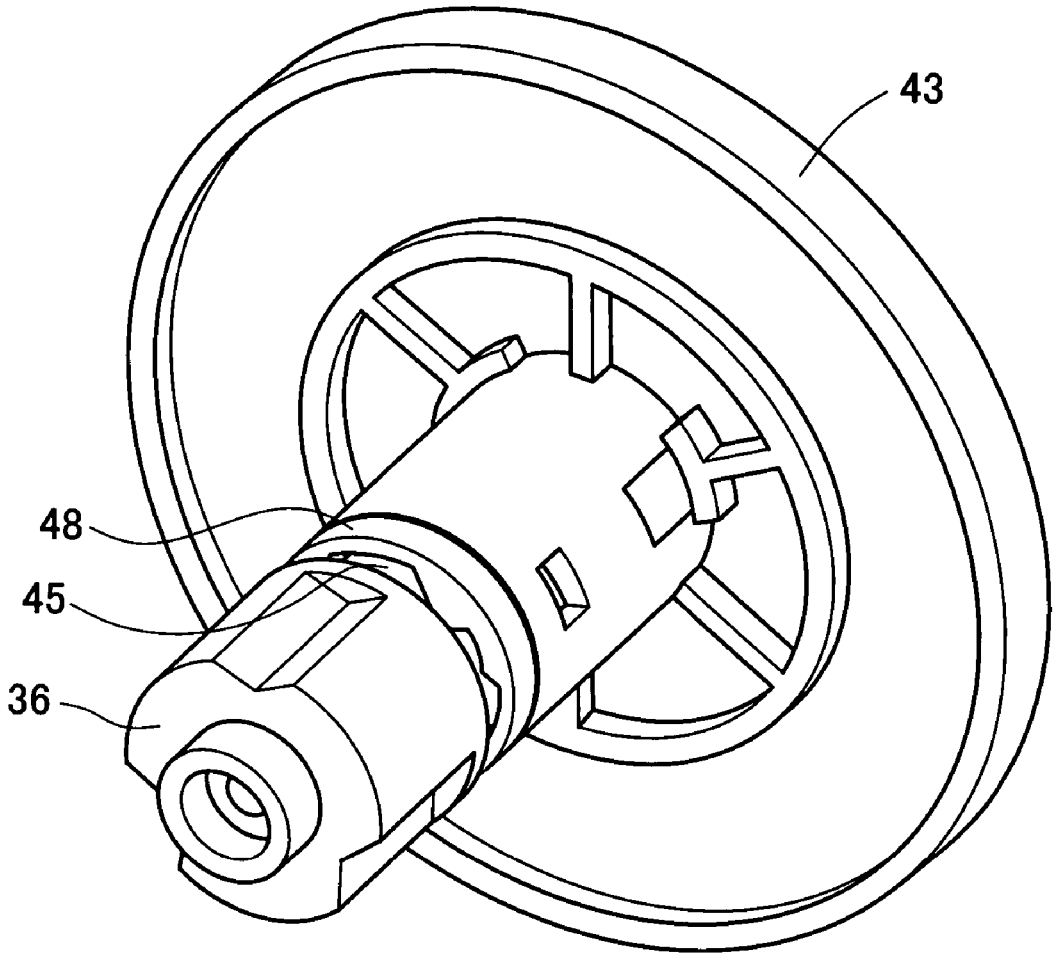
FIG. 3 is an oblique perspective view showing the connector portion directed to the first embodiment.
Figure 4:
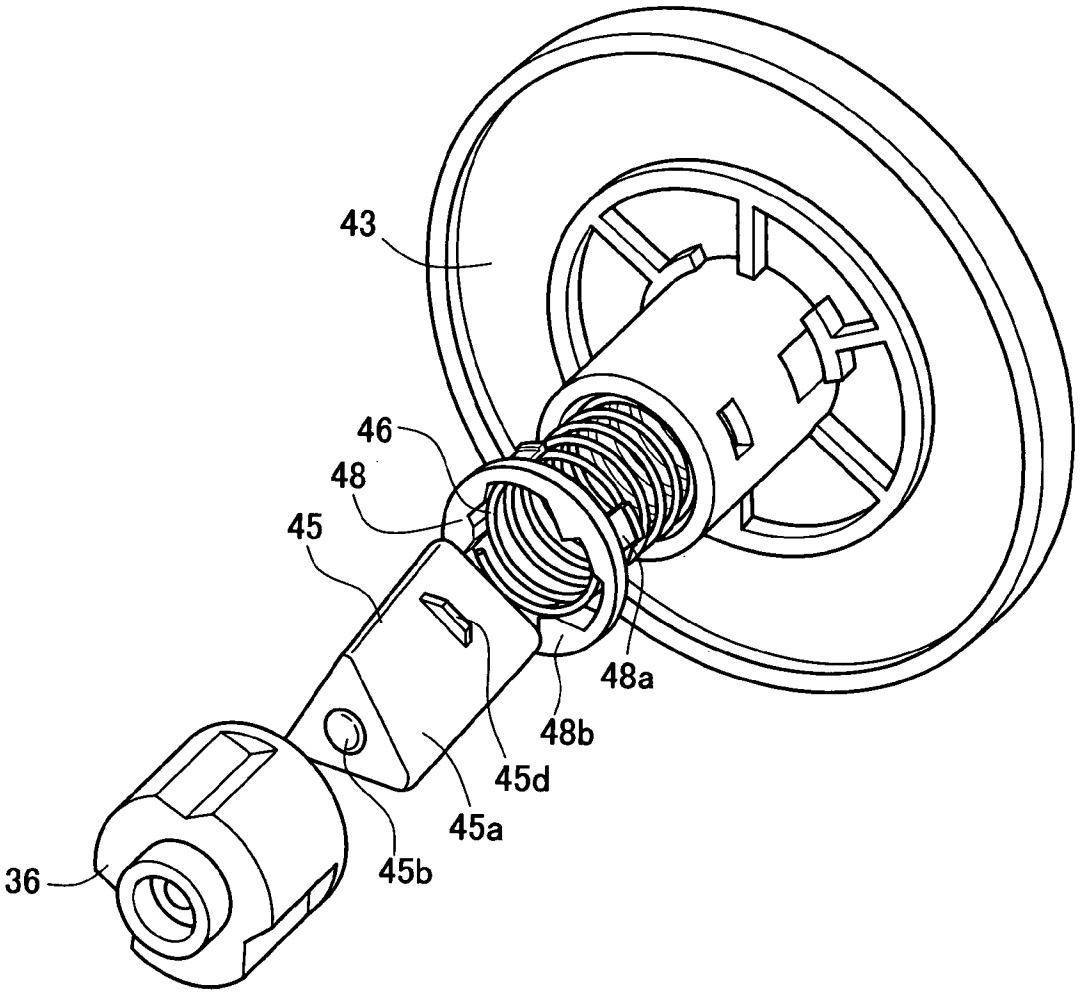
FIG. 4 is an exploded oblique perspective view showing the connector portion directed to the first embodiment.

Next, there will be schematically described a connector portion of the main body 2 and an image forming unit 30 by referring to FIG. 2 through FIG. 4. This connector portion is arranged at the rear end of the color printer 1 shown in FIG. 1. FIG. 2 is a sectional view of the connector portion. FIG. 3 is an oblique perspective view (right-half side) of what is shown in FIG. 2 (connected state). FIG. 4 is an exploded oblique perspective view of the same.

An image forming unit 30 includes a photosensitive body 21 and is removable from the main body 2. As shown in the left side of FIG. 2, a flange 32 is fixed to the end portion of the photosensitive body 2 and a rotation axis 34 of the photosensitive body 21 is fixed to the flange 32. A coupling 36 is attached to the end portion of the rotation axis 34. Since the coupling 36, the rotation axis 34, the flange 32 and the photosensitive body 21 are fixed to one another; they unite to rotate when they receive rotation driving force from the main body 2.

As shown in the right side of FIG. 2, at the side of the main body 2, a gear 43 is fixed to the cover body 20 via a gear shaft holder 44. A joint holder section 43*a* is attached to the gear 43 and extends leftward in FIG. 2. The joint holder section 43*a* is substantially cylinder shaped. Inside the joint holder section 43*a*, there are formed a joint 45, and a hole 47 in which a spring 46 is inserted. Furthermore, a ring 48 is attached to the left end of the joint holder section 43*a*. The ring 48 has three fixing feet 48*a*, and a dislocation stopper section 48*b* protruding toward its inner periphery. The gear 43, the gear shaft holder 44, the joint 45 and the ring 48 are made of resin. The fixing feet 48*a* for the ring 48 are snap-fitted to a fixing aperture 43*b* formed on the joint holder section 43*a* by making use of flexibility of resin.

The gear 43 transmits driving force generated by a power source arranged inside the main body 2 to the joint 45. Details will be described later, but concisely, the hole 47 for the joint holder section 43*a* and the joint 45 are in contact with each other partially to transmit rotation. The gear shaft holder 44 is fixed to the cover body 20 and holds the gear 43 rotatably. When an image forming unit 30 is attached to the main body 2, the spring 46 is pushed and shrunken, thereby to urge the joint 45 leftward in FIG. 2.

Figure 5:
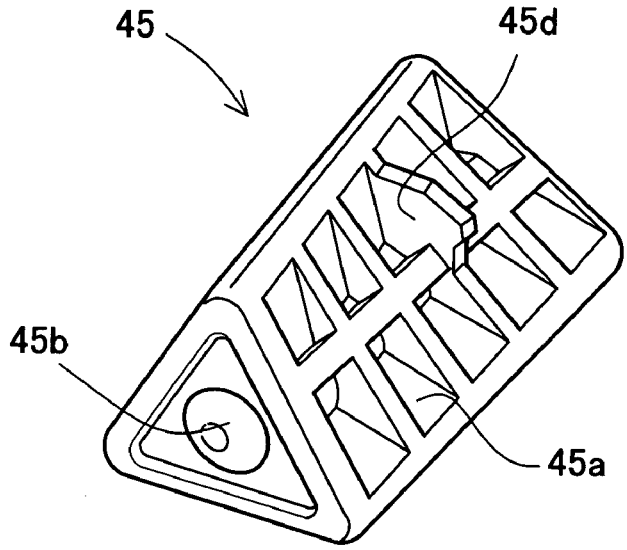
FIG. 5 is an oblique perspective view showing a shape of a joint directed to the first embodiment.

Next, there will be described the shape of the joint 45. As shown in FIG. 4, the joint 45 has a twisted triangle-pole-shaped main body section 45*a*. At the front-side center of the joint 45 shown in FIG. 4, a hemispherical front edge section 45*b* is formed thereon, and at both of the sloped surfaces, side projections 45 are formed. The joint 45 and its accessory sections are united and made of resin such as polyacetale (POM), polycarbonate (PC) and the like. Furthermore, as shown in FIG. 5, the joint may have scraped portions.

Figure 6:
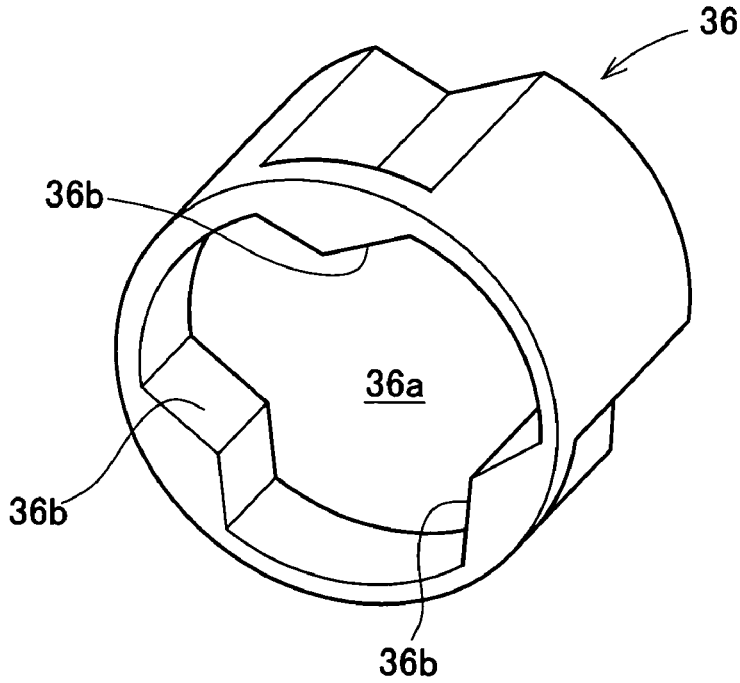
FIG. 6 is an oblique perspective view showing a coupling directed to the first embodiment.

As shown in FIG. 2 and FIG. 3, the joint 45 is in contact with the coupling 36, and joint holder section 43*a* for the gear 43 when an image forming unit 30 is attached to the main body 2. At the sides of these parts in contact with the joint 45, there are formed a contact hole 36*a* for the coupling 36 and a contact hole 47 both of which are shaped like a not-twisted triangular pole. For example, looking the coupling 36 of FIG. 2 from right side, there is formed a complicated shaped contact hole 36*a* inside, as shown in FIG. 6. What are important are three contact surfaces 36*a* which form a not-twisted triangular pole like shape. Furthermore, on the inner surface of the joint holder section 43*a*, there is formed a contact hole 47 which has three contact surfaces forming a not-twisted triangular pole like shape, similarly.

Figure 7:
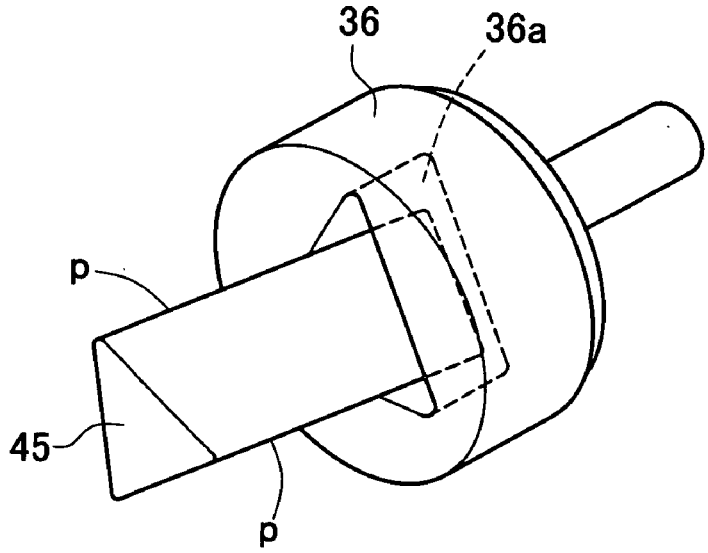
FIG. 7 is a diagram illustrating relation of a joint and a coupling directed to the first embodiment.
Figure 8:
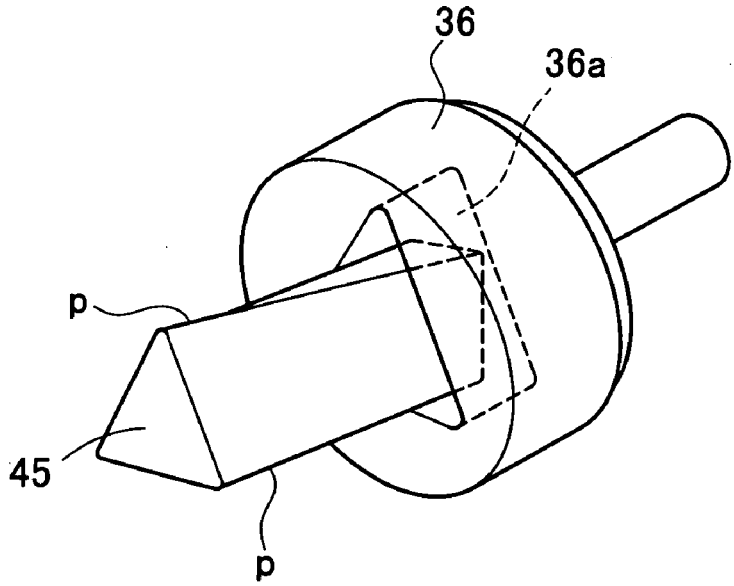
FIG. 8 is a diagram illustrating relation of a joint and a coupling directed to the first embodiment.

Next, there will be described transmission of rotation driving force by the joint 45 and the contact holes 36*a*. For better understanding of it, FIG. 7 and FIG. 8 cut out and show a rotation transmitting portion by the coupling 36 with not-twisted triangular pole like contact hole 36*a* and a rotation transmitting portion by a helical triangular pole like joint 45, respectively. For simple description, it is supposed that the contact 36*a* has only contact surfaces 36*b* when referring to FIG. 7 and FIG. 8. As shown in those figures, regardless of positioning relation between center of the joint 45 and that of the coupling 36, two or more of the three edge lines 'p' are never set in parallel to inner surfaces of the contract hole 36. Therefore, each of the three edge lines 'p' for the joint 45 comes to contact with each of the three inner surface of the contact hole 36*a* at one point along relative rotation of the joint 45 and the coupling 36. That is, the joint 45 and the contact hole 36 meet at three points each other along rotation, whereby rotation driving force is transmitted.

It is to be noted that relation of diameters of the joint 45 and of the contact hole 36*a* is set to a range as follows. Looseness between the joint 45 and the contact hole 36*a*, difference of the diameters, is set smaller than looseness that the joint 45 idles in the contact hole 36*a*. That is, diameter of the joint 45 is set larger than minimum diameter of the contact hole 36*a*. Furthermore, the looseness is set larger than looseness the joint 45 can be just inserted in the contact hole 36*a* when centers of the joint 45 and of the contact hole 36*a* fall into maximum center and angle of deviation allowable for the image forming apparatus. That is, diameter of the joint 45 is set smaller than maximum diameter of the contact hole 36*a*. Since diameters of them are thus set, the joint 45 can be inserted in the contact hole 36*a* easily. Furthermore, for better insertion of the joint 45 into the contact hole 36*a* and meeting state of those, it is preferable that each edge line 'p' for the joint 45 is chamfered with a curved surface.

Since insertion of the joint 45 into the contact hole 63*a* is easy, insertion of an image forming unit 30 into the main body 2 in axis direction is easy, as well. At the stage immediately after the insertion, centers of the joint 45 and of the coupling 36 may not coincide completely. However, after that, the joint 45 and the contact hole 36*a* are relatively rotated, whereby they come to contact with each other at three points. At this stage, the centers coincide with each other due to the three contact points, viewed from its sectional position.

On the other hand, even if the centers somewhat deviate from each other, the joint 45 and the contact hole 36*a* can be in contact with each other at three points. Therefore, along rotation after insertion of those, deviation of center between the coupling 36 and the joint 45 is absorbed by tilt of the joint 45. Furthermore, the coupling 36 and the joint 45 are surely coupled each other due to the three contact points while deviation of center remains. Same mechanism works between one end of the joint 45 and the coupling 36 for an image forming unit 30, and between the other end of the joint 45 and the joint holder section 43*a* formed on the gear 43 for the main body 2.

Figure 9:
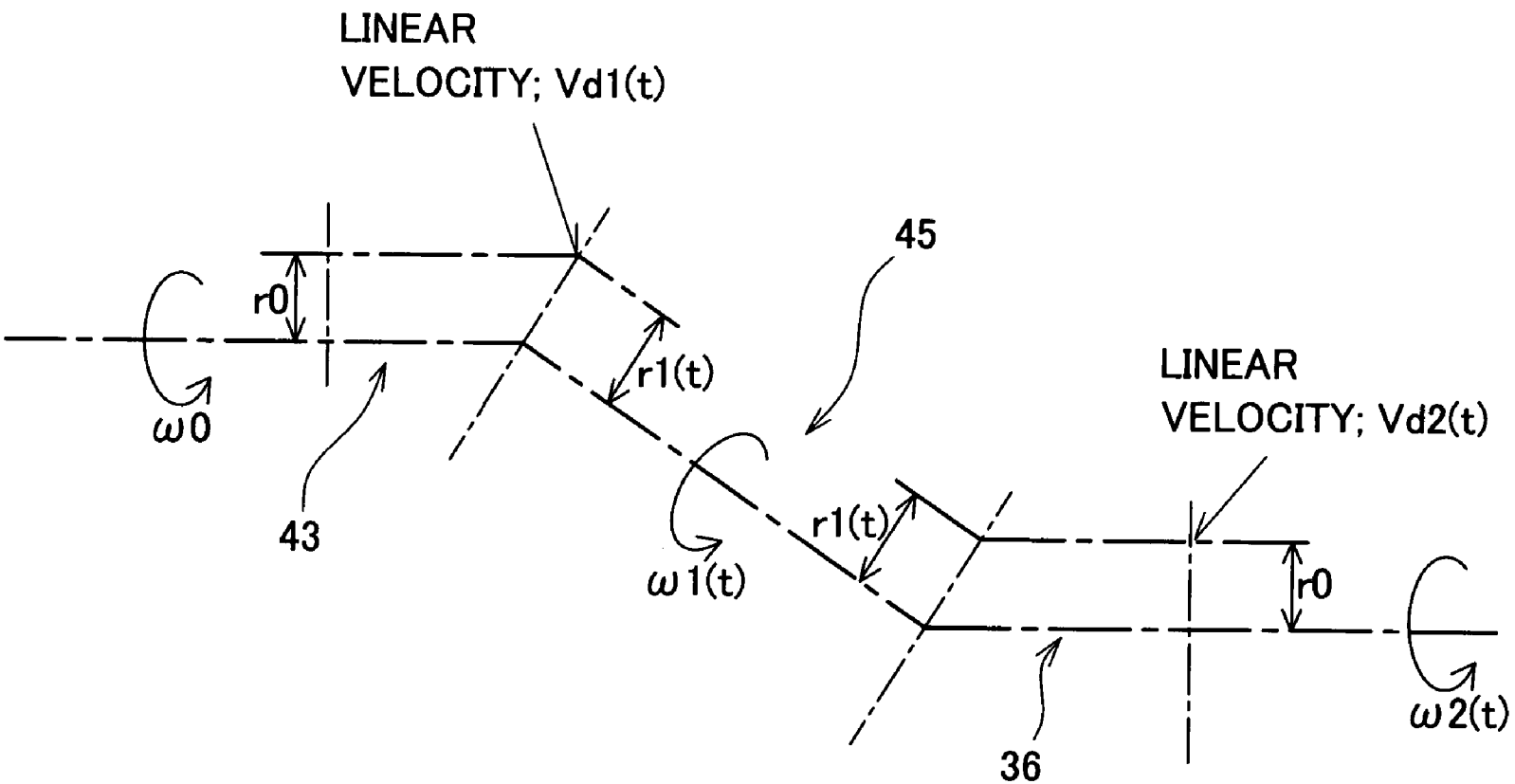
FIG. 9 is a diagram illustrating state of driving force transmission directed to the first embodiment.

Next, there will be described the fact that rotation is accurately transmitted even though two parts are coupling with centers of those axes deviating. FIG. 9 schematically shows rotation state of the gear 43 and the coupling 36 connected by the joint 45 in tilt. Firstly, when angular velocity of the gear 43 and a reference radius are defined as ω0 and r0, respectively, linear velocity Vd1 (t) of the gear 43 at a reference radius position is expressed with an expression (1).

$$Vd\mathbf{1}\ (t)=r\mathbf{0}*\omega\mathbf{0} \tag{1}$$

Furthermore, linear velocity of the gear 43 and that of the joint 45 are equal at their contact point. Therefore, provided that rotation radius of the joint 45 under coupled state, corresponding to the reference radius r0, is r1 (t), angular velocity of ω1 (t) for the joint 45 is expressed with an expression (2).

$$\omega 1(t)=Vd1\ (t)/r1(t) \tag{2}$$

Furthermore, when right hand side of the expression (1) is substituted for Vd1 (t) in the expression (2), an expression (3) is obtained.

$$\omega 1(t)=r0*\omega 0/r1(t) \tag{3}$$

On the other hand, at the coupling 36 side, angular velocity of the joint 45 is ω1 and at their contact point, linear velocity of the joint 45 and that of the coupling 36 are equal. Accordingly, linear velocity Vd2 (t) of the coupling 36 at a point on rotation radius r1 (t) of the joint 45 is expressed with an expression (4).

$$Vd2(t)=r1(t)*\omega 1(t) \tag{4}$$

When ω1 (t) in the right hand side of the expression (4) is substituted by the right hand side of the expression (3) an expression (5) is obtained.

$$\begin{aligned} Vd2(t) &= rI(t)*r0*\omega 0/rI(t) \\ &= r0*\omega 0 \end{aligned} \tag{5}$$

On the other hand, since rotation radius of the coupling 36 at the contact point of the coupling 36 and the joint 45 is r0, angular velocity ω2 (t) of the coupling 36 is expressed with an expression (6)

$$Vd2(t)=r0*\omega 2(t) \tag{6}$$

Accordingly, an expression (7) can be obtained by substituting the expressions (5) and (6).

$$\omega 2(t)=\omega 0 \tag{7}$$

Thereby, angular velocity of the coupling 36 and that of the gear 43 are equal and the coupling 36 keeps steady state rotation. Accordingly, even if center of the joint 45 and that of the coupling 36 do not meet each other, they are coupled as they are and driving force in rotation direction is surely transmitted.

Figure 10:
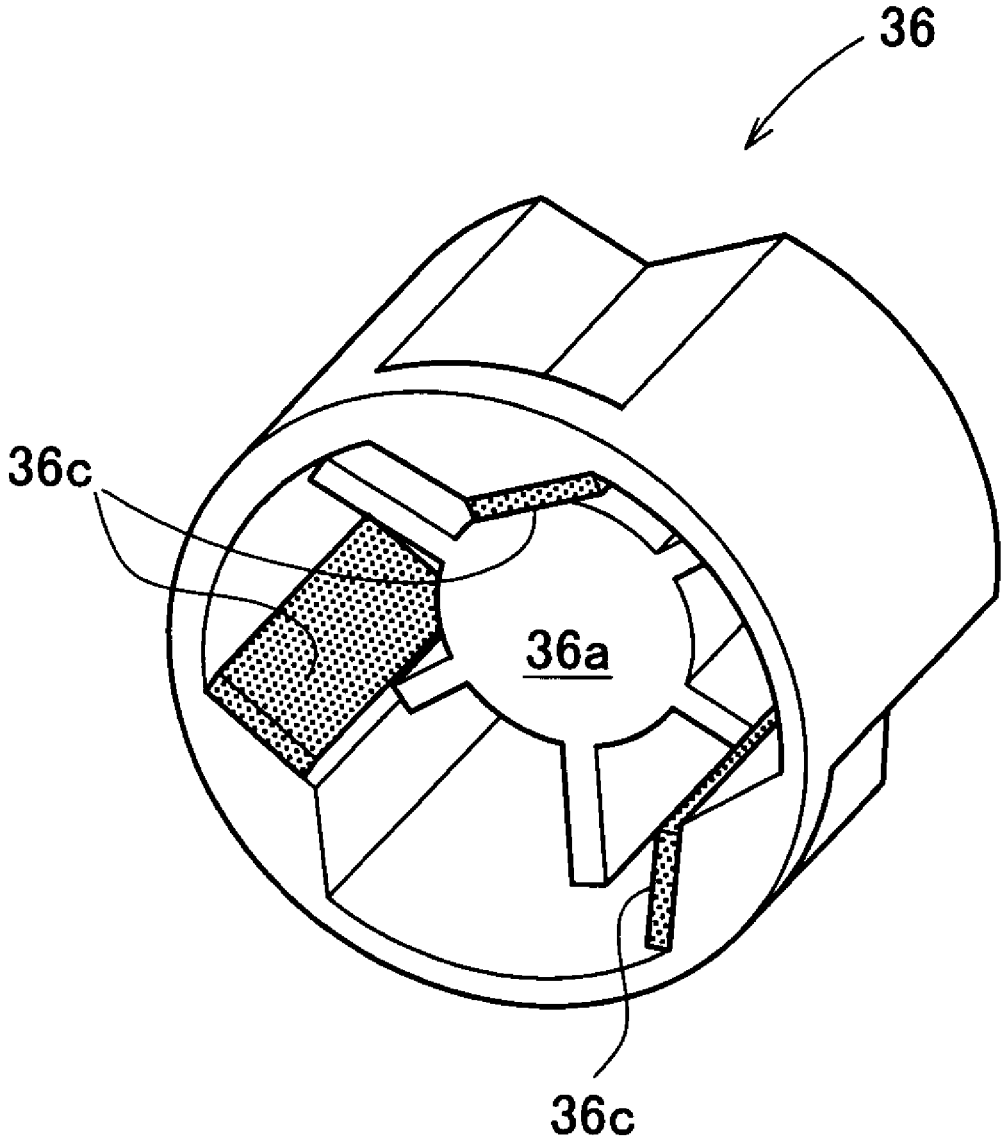
FIG. 10 is an oblique perspective view showing a coupling directed to the first embodiment.

Furthermore, the coupling 36 may be formed as shown in FIG. 10. For example, scraped portions may be formed around the bottom portion the contact hole 36*a*. Since the edge lines 'p' of the joint 45 come to contact with the contact surfaces 36*b*, the contact surfaces 36*b* may be protected with protection material pieces 36*c* which have enough strength. Particularly, since the gear 43 is made of material of high lubrication, there arises a fear that contact surface of the contact hole 47 on the joint holder section 43*a* is scraped due to contact of the joint 45. Therefore, it is preferable that inner surface of the joint holder section 43*a* is covered with a protection material piece 36*c* for eliminating such fear. As material of a protection material piece 36*c*, metal plate and the like is suitable, for example.

Thus structured, the junction of the joint 45 and the coupling 36 is just mated in rotation direction, and movement in an axis direction is free. Therefore, a user can remove this image forming unit 30 easily by moving it in an axis direction. When an image forming unit 30 is removed from the main body 2, it changes from a state as shown FIG. 2 to contact-force-free state, i.e., contact force toward the joint 45 by the coupling 36 (force of rightward in FIG. 2) does not work. Therefore, urging force of the spring 45 pushes out the joint 45 leftward in FIG. 2. Since a projection 45*d* for the joint 45 comes to contact with the displacement stopper section 48*b* for the ring 48, the joint 45 does not get displaced.

As described, according to the color printer 1 directed to the present embodiment, joint 45 which has twisted triangle pole shape and contact holes 36*a*, 47 which are not twisted are used for the junction of the image forming unit 30 and the main body 2. Since they contact with one another at three points due to driving force in a rotation direction, their shaft centers in contact state coincide with one another. On the other hand, since there are three contact points, tilt of rotation axis is allowed to some extent. Accordingly, rotation is transmitted accurately with rotation velocity being kept constant while center of the axis tilts. Thereby, even if centers of the input/output axes are not aligned with each other, stress is never added to theirs holder sections and rotation transmit accuracy between input/output axes can be secured without using material of high hardness.

Furthermore, in the present embodiment, there is arranged a contact member of which end section has diameter smaller than maximum diameter of the concave section and larger than minimum diameter of the concave section. Thereby, insertion in the concave section of the edge section is easy. Furthermore, since contact members are arranged on the contact sections, the contact members receive contact force on contact points. Thereby, influence such as deformation of the concave section is avoided.

Furthermore, in the present embodiment, there is provided the elastic member for urging the first driving force transmitting member and the intermediate driving force transmitting member to be separated from each other, the concave section has a projecting section protruding inward from side section of the concave section, and the end section has displacement stopper section to be in contact with the projecting section from back side. Thus structure, the first driving force transmitting member and the second driving force transmitting member are separated when driving force is not transmitted. Therefore, attachment/removal of a process unit is easy. Furthermore, when those driving force transmitting members are separated, the projecting section and the displacement stopper section are made contact with each other, the intermediate driving force transmitting member does not get displaced.

Furthermore, in the present embodiment, both the first driving force transmitting member and the second driving force transmitting member have concave sections, the intermediate driving force transmitting member has the end sections to be located in the concave sections at its both ends, the concave section of the first driving force transmitting member has the projecting section protruding inward from side section of the concave section, and the intermediate driving force transmitting section has the displacement stopper section to be in contact with the projection section from back side and an elastic member for urging the first driving force transmitting member and the intermediate driving force transmitting member to be separated from each other. Thus structured, attachment/removal of a process unit is easy and the intermediate driving force transmitting member does not get displaced.

The inventive image forming apparatus can secure rotation transmission accuracy among input/output axes without giving stress to a holding portion despite shaft misalignment and without using material of high strength.

Second Embodiment

Hereinafter, the second embodiment of the present invention will be described in detail with reference to the accompanying drawings. This embodiment also concerns an application of the present invention to the tandem type color printer. The entire configuration of this embodiment is the same as FIG. 1 of the first embodiment.

Figure 11:
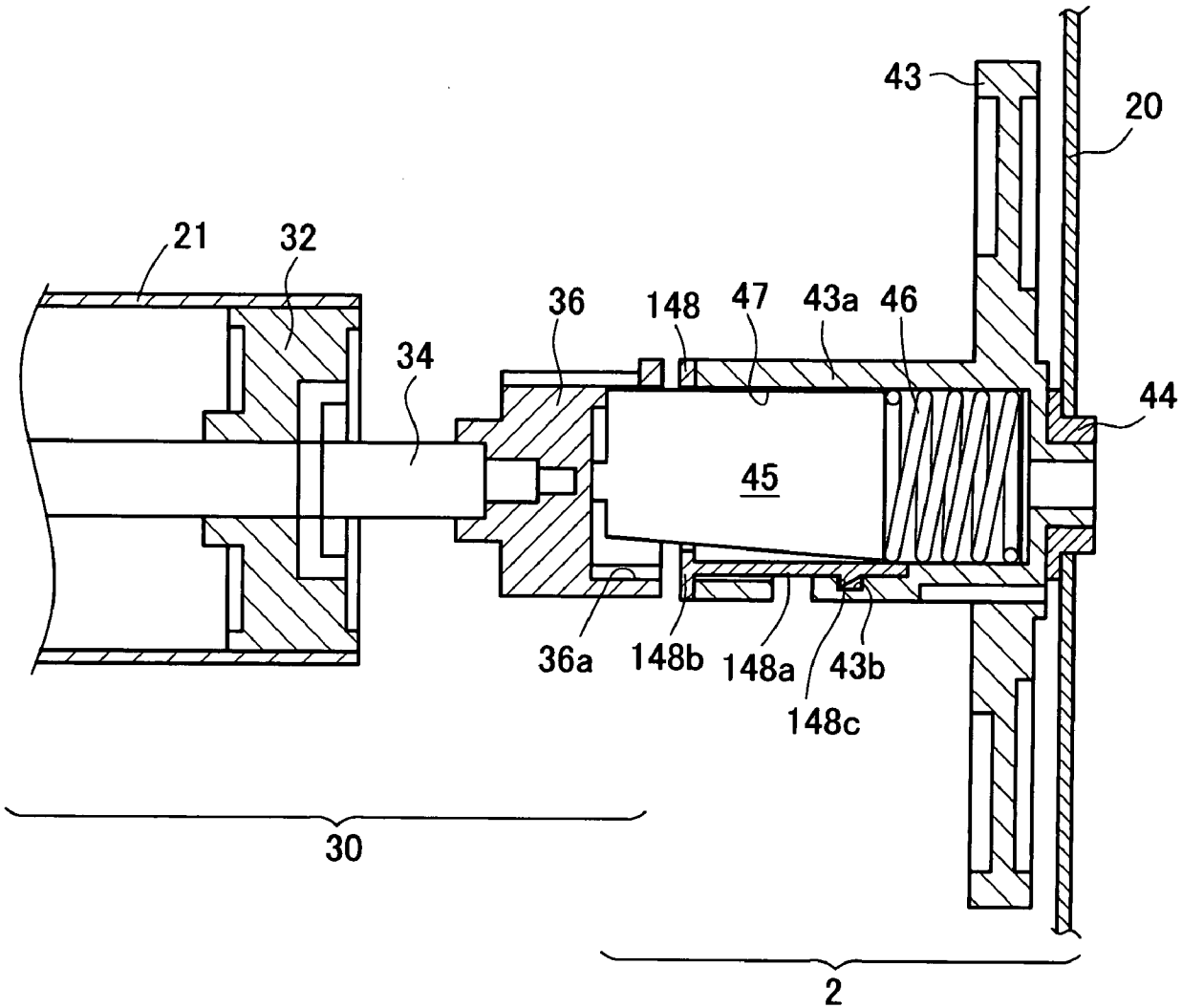
FIG. 11 is a sectional view showing connector portion directed to a second embodiment.
Figure 12:
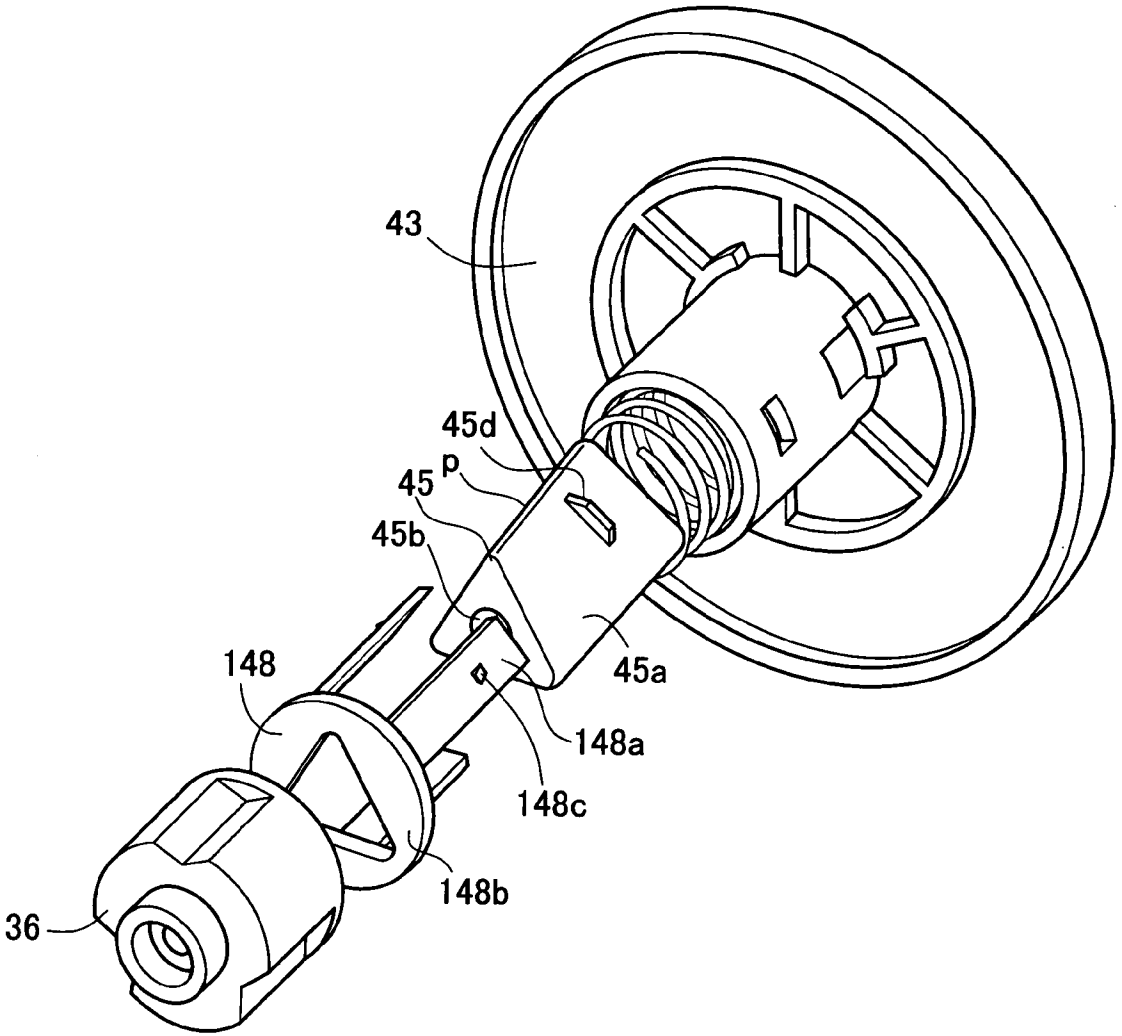
FIG. 12 is a an exploded oblique perspective view showing the connector portion directed to the second embodiment.

Next, FIGS. 11, 12 show an outline of the connecting portion of the main body 2 and image forming unit 30 of this embodiment. This connecting portion is disposed on a deeper side in FIG. 1 of the color printer. FIG. 11 shows a sectional view of this connecting portion. FIG. 12 is an exploded oblique perspective view of the right half of FIG. 11. In the image forming unit 30, as shown on the left side of FIG. 11, a flange 32 is fixed to an end portion of a photosensitive body 21 and the rotation shaft 34 of the photosensitive body 21 is fixed onto the flange 32.

On the side of the main body 2, as shown on the right side of FIG. 11, a gear 43 is fixed to a cover box 20 through a gear shaft holder 44. A joint holder section 43*a* is formed on the gear 43 such that it is extended to the left side in this Figure. The joint holder section 43*a* is formed substantially cylindrical and a hole 47 is formed inside thereof, in which a joint 45 and a spring 46 are accommodated. The gear 43, the gear shaft holder 44 and the joint 45 are formed of resin. A protection ring 148 is attached to the left end portion of the joint holder section 43 in FIG. 11.

The gear 43 transmits a driving force outputted from a drive unit provided inside the main body 2 to the joint 45. The gear shaft holder 44 is fixed to the cover box 20 so as to support the gear 43 rotatably. The joint 45 contains a main body section 45*a* which is of a twisted triangle pole. Further, a semispherical front edge section 45*b* is formed in the center of a forward side of FIG. 12 while a side projection 45*d* is formed on each side face thereof. When the image forming unit 30 is installed on the main body 2, the spring 46 is compressed so that the joint 45 is urged to the left side in FIG. 11.

Figure 13:
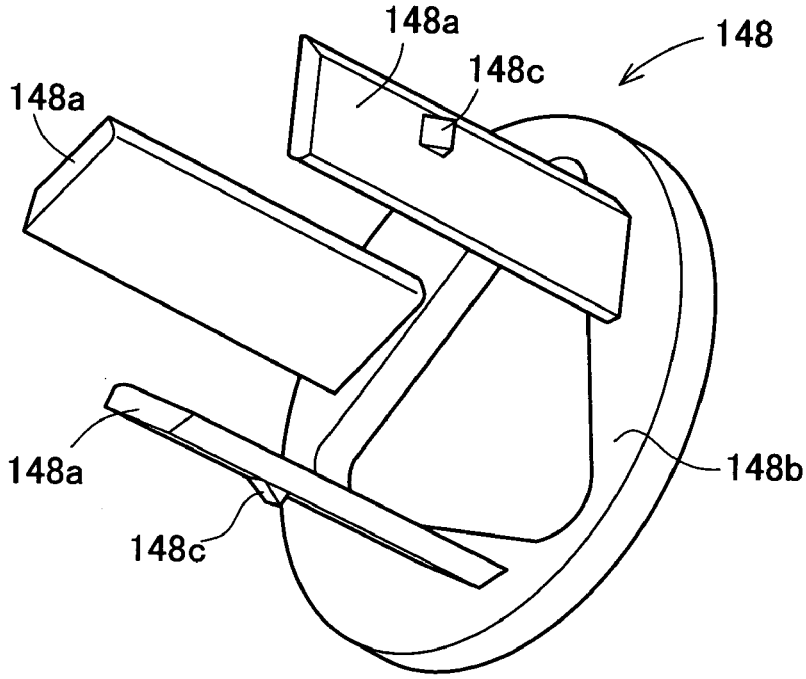
FIG. 13 is an oblique perspective view showing a protective ring directed to the second embodiment.

As shown in FIGS. 12, 13, the protection ring 148 comprises three rectangular sheet-like protecting sections 148 parallel to the axial direction and a substantially ring-like displacement stopper section 148*b* perpendicular to the axis. Each protecting section 148*a* has a claw 148*c* on its outer face to be fixed. This protection ring 148 is formed integrally of resin having a sufficiently high resistance to plastic deformation as compared to the joint 45. As shown in FIG. 11, the claw 148*c* of the protection ring 148 is snap-fit to a fixing hole 43*b* formed in the joint holder section 43*a* by using the plasticity of the resin.

Figure 14:
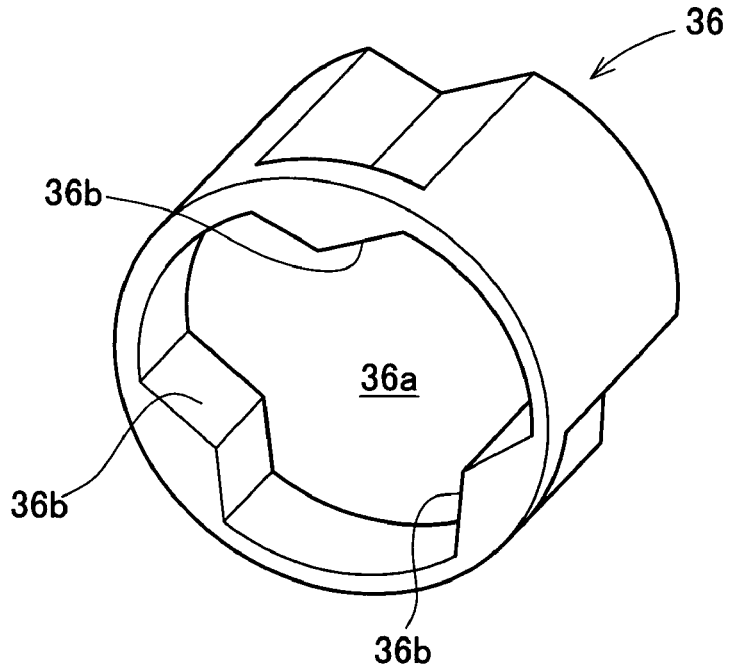
FIG. 14 is an oblique perspective view showing a coupling directed to the second embodiment.

When the image forming unit 30 is installed on the main body 2 as shown in FIG. 11, the coupling 36 of the image forming unit 30 and the joint holder section 43*a* of the gear 43 are placed such that they oppose each other across a short distance through the joint 45. On the sides of the joint 45 of these members, a non-twisted triangular prism hole 36*a* and a hole 47 are formed. If the coupling 36 is seen from the right side of FIG. 11, a hole 36*a* having a complicated shape is formed as shown in FIG. 14. Three contact faces 36*b* are important and these contact faces 36*b* form the non-twisted triangular prism hole.

Figure 15:
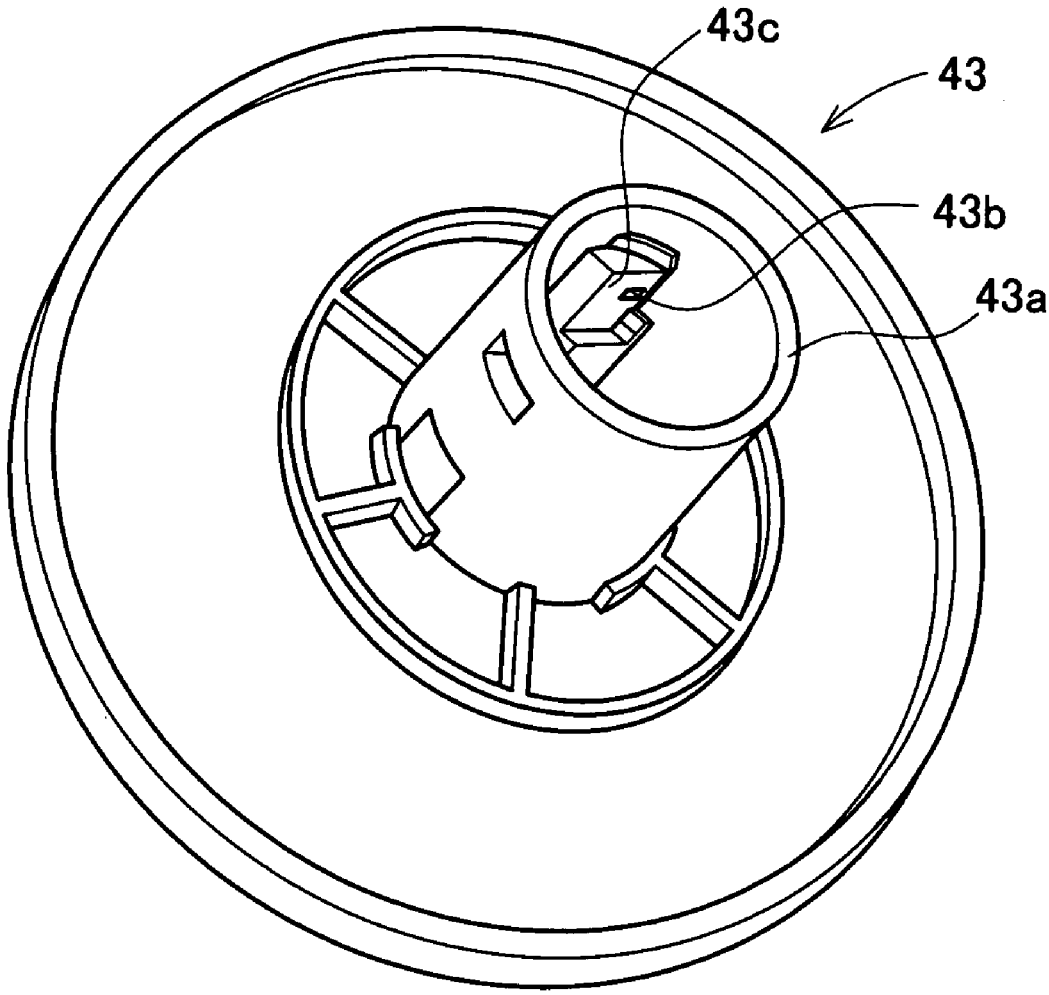
FIG. 15 is an oblique perspective view showing a joint receptor section of a gear directed to the second embodiment.

As shown in FIG. 15, three contact sections 43*c* are formed corresponding to the non-twisted triangular prism hole on the inner face of the joint holder section 43*a*. A fixing hole 43*b* which engages the claw 148*c* of the protection ring 148 is formed on the contact section 43*c* and each protecting section 148*a* of the protection ring 148 is attached thereto. Therefore, the three contact sections 43*c* are covered by each protecting section 148*a*. As a result, the inner face of the protecting section 148*a* functions as the triangular prism hole 147.

Next, a transmission of rotary driving force with this twisted triangular prism joint 45 and the non-twisted triangular prism hole 36*a* will be described. Due to a relative rotation of the joint 45 and the coupling 36, each edge line 'p' of the joint 45 makes contact with the three contact faces 36*b* of the hole 36*a* only through a single point. As for the sectional position, the axes of the coupling 36 and the joint 45 overlap at the same position because of the three contact points. On the other hand, even if the inclinations of the both axes are slightly different, a deflection of the axis between the coupling 36 and the joint 45 is absorbed by the inclination of the joint 45. Further, even if the axes incline, the coupling 36 and the joint 45 are engaged with each other securely through the three contact points. This is the same for the relation between the joint 45 and a hole 47 formed by the protecting section 148*a*.

The joint 45 and the holes 36*a*, 47 are fit to each other through the three points for driving in the rotation direction so as to transmit a rotary driving force. This phenomenon occurs through both end portions of the joint 45 both on the side of the coupling 36 of the image forming unit 30 and the side of the joint holder section 43*a* formed in the gear 43 of the main body 2. Further, to improve an insertion and fitting condition between the joint 45 and the holes 36*a*, 47, preferably, each edge line 'p' of the joint 45 is rounded.

Because the rotary driving force is transmitted through the three contact points between the joint 45 and the holes 36*a*, 47 at this time, force is applied concentratedly on the three points of the holes 36*a*, 47. If wearing or plastic deformation occurs in the hole 36*a*, 47 due to a long term usage, unfavorably, the function for absorbing a deflection of the axis by the joint 45 may be hampered. In this color printer 1, the hole 47 of the gear 43 is constituted with an inside face of the protecting section 148*a* of the protection ring 148. Because the protection ring 148 has a large resistance to the plastic deformation, even if a concentrated force is applied, there is no fear that the plastic deformation may occur. Further, because the image forming unit 30 is replaced appropriately, the coupling 36 is never used continuously for too long a period. Thus, there is no fear that the hole 36*a* in the coupling 36 may be plastically deformed.

Figure 16:
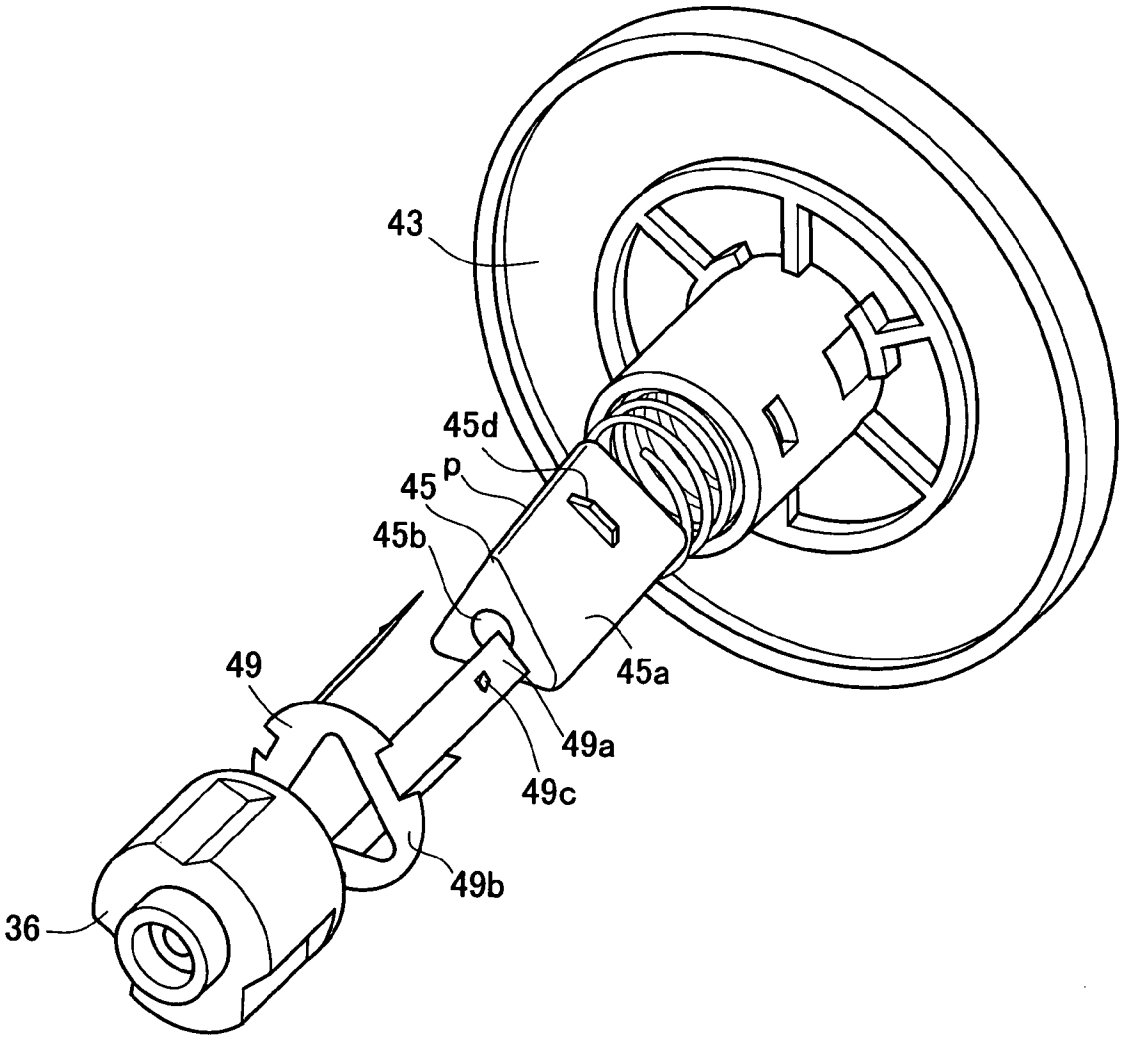
FIG. 16 is a an exploded oblique perspective view showing another example of a connector portion directed to the second embodiment.

Further, as shown in FIG. 16, it is permissible to use a metallic plate protection ring 49 instead of the resin made protection ring 148. As the metallic plate, it is possible to use a carbon steel (SECC), a hardened leaf spring sheet metal or the like. Because the protection ring 49 is a very small component, its influence upon entire weight and cost is small even if it is made of metal. The protecting section 49*a* can be formed integrally by incising the displacement stopper section 49*b* of the protection ring 49 and then bending it, as shown in FIG. 16. Further, the claw 49*c* can be formed by bending part of the protecting section 49*a*. Forming the protection ring 49 of metal enhances the durability thereby securing a high protecting effect.

With the above described structure, the joint 45 and the coupling 36 are fit to each other only in the rotation direction while they can move freely in the axial direction. Therefore, user can fit or remove easily by moving this image forming unit 30 in the axial direction. If the image forming unit 30 is removed from the main body 2, the contact force by the coupling 36 in the direction to the right side of the same Figure to the joint 45 extinguishes from the state shown in FIG. 11. Thus, the joint 45 projects in the direction to the left side of the Figure due to an urging force of the spring 46.

Because the side projection 45*d* of the joint 45 makes contact with the displacement stopper sections 148*b*, 49*b* of the protection rings 148, 49 at this time, the joint 45 never slips out.

As described above, in the color printer according to this embodiment, the twisted triangular prism joint 45 and the non-twisted triangular prism holes 36*a*, 47 are employed in the connecting portion between the image forming unit 30 and the main body 2. Because these make contacts through three points due to a driving force in the rotation direction, this contact position makes the axial positions of the both coincide with each other. On the other hand, because the contact points are only three points, the inclination of the rotation axis is permitted to some extent. Thus, with the axis inclined, the rotation is transmitted at a high precision while maintaining the rotation velocity. Consequently, no stress is applied to the holding portion even if the axes of the input/output shafts deflect and even if no material having a high strength is used, the rotation transmission accuracy between the input and output shafts can be secured.

The protection ring 148, 49 are attached to the joint holder section 43*a* of the gear 43, so that its inner face functions as the hole 47. Therefore, even if the edge line 'p' of the joint 45 makes contact, there is no fear about wearing or plastic deformation. Thus, the durability of the color printer 1 is high.

Furthermore, in the present embodiment, there is a protection member inserted in the concave section and located between wall surface of the concave section and side surface of the intermediate driving force transmitting member, and the displacement stopper section is a part of the protection member. Therefore, the intermediate driving force transmitting member comes to contact with the protection member but not with the wall surface of the concave section. As a result, the wall surface of the concave section does not wear out and there is thus provided an image forming apparatus excellent in durability. Furthermore, since the displacement stopper section is provided on the protection member, the number of members for the apparatus does not increase.

Furthermore, in the present embodiment, there is a fixer section for fixing outer surface of the protection member and wall surface of the concave section to each other. Therefore, the outer surface of the protection member and the wall surface of the concave section are fixed together by the fixer section. Thereby, the protection member does not get displaced.

Furthermore, in the present embodiment, the protection member is superior to the first driving force transmitting member and the intermediate driving force transmitting member with respect to abrasion durability. Therefore, the first drive force transmit member or the intermediate drive force transmit member can be prevented from being worn out. Accordingly, there is thus provided an image forming apparatus excellent in durability.

In the meantime, this embodiment is only a mere representation and never restricts the present invention. Thus, the present invention may be improved or modified in various ways within a range not departing from the gist of the invention. Although the claws 148*c*, 49*c* for engaging the protection rings 148, 49 with the joint holder section 43*a* are provided on the outer face of the protecting sections 148*a*, 49*a* according to the above-described embodiment, they may be provided independently of the protecting sections 148*a*, 49*a*. Further, it is permissible to provide the protection rings 148, 49 with an engagement hole while providing the claw on the side of the joint holder section 43*a*. Further, the fixing method of the protection rings 148, 49 may be by press-fitting with a severe tolerance (for example, about −0.1~0.0 mm) instead of the engagement between the fixing hole 43*b* and the claws 148*c*, 49*c*.

The image forming unit of the present invention is capable of securing a rotation transmission accuracy between the input and output shafts with a simple structure and has a high durability thereby preventing the joint from slipping out.

Third Embodiment

Hereinafter the third embodiment of the present invention will be described in detail with reference to the accompanying drawings. This embodiment is different from the first embodiment in only the connecting portion between the image forming unit 30 and the main body 2. Because the entire structure thereof is substantially equal, only different points will be described here.

Figure 17:
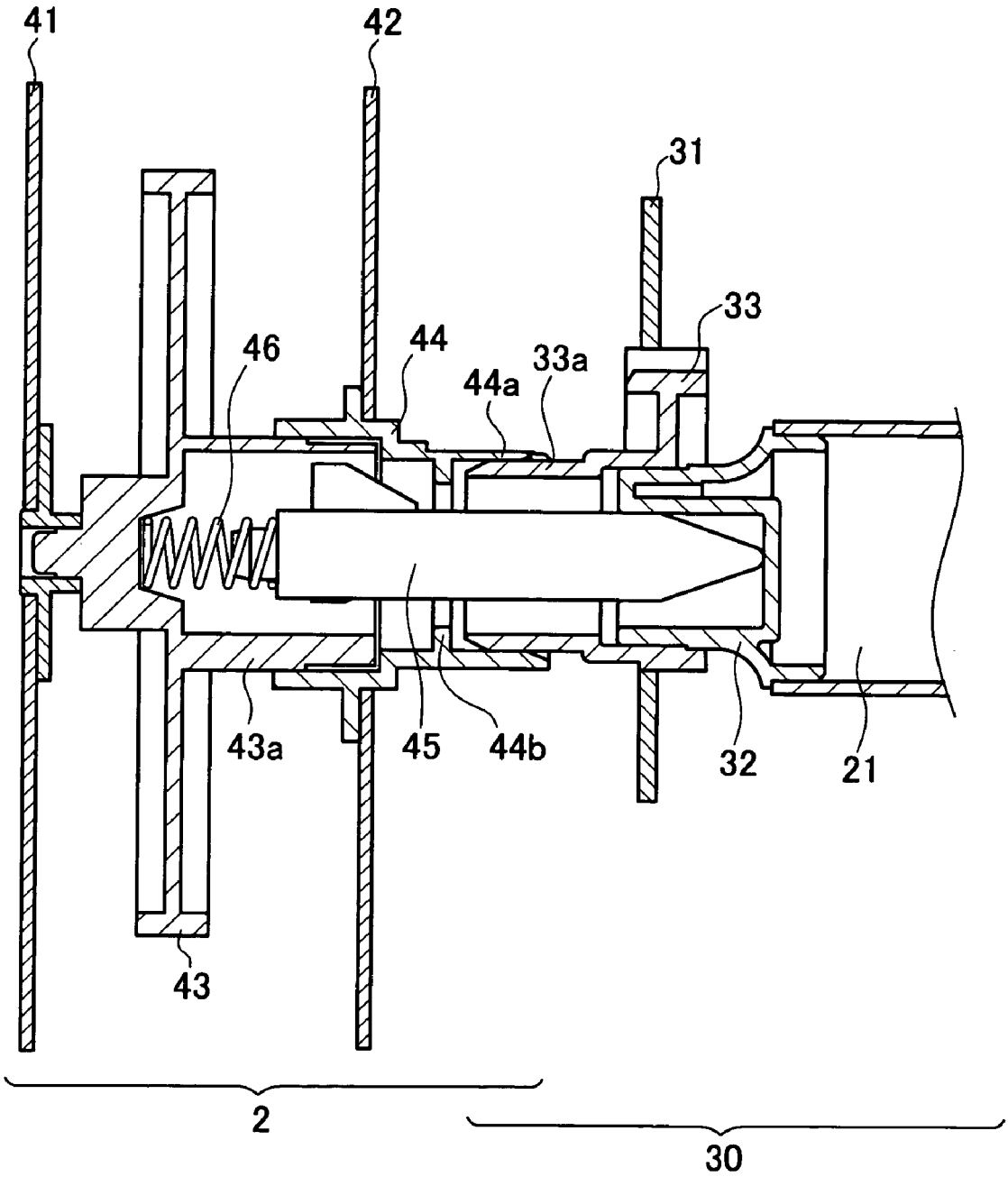
FIG. 17 is a sectional view showing connector portion of a color printer directed to a third embodiment.

FIG. 17 shows the schematic structure of the connecting portion of this embodiment. In this Figure, the image forming unit 30 is represented on the right side thereof. The image forming unit 30 is held by the housing 31 and it includes a photosensitive body 21, a flange 32 and a shaft holder 33. The flange 32 is fixed to an end portion of the photosensitive body 21 and rotated integrally with the photosensitive body 21. The shaft holder 33 supports an end portion of the flange 32 rotatably and is fixed to the housing 31. A cylindrical fixing section 33*a* is formed at a left end portion in the Figure of the shaft holder 33.

In the main body 2, as shown on the left side of FIG. 17, a gear 43, a gear shaft holder 44, a joint 45 and a spring 46 are attached to the frames 41, 42 fixed on the cover box 20. The gear 43 transmits a driving force from a drive unit provided within the main body 2 to the joint 45. The gear 43 has a joint holder section 43*a* which is extended in the direction of the right side in the same Figure. The gear shaft holder 44 is fixed on the frame 42 and supports the joint holder section 43*a* of the gear 43 rotatably. A cylindrical fixing section 44*a* is formed at a right end portion in the Figure of the gear shaft holder 44. A displacement stopper section 44*b* is formed on an inner peripheral face in the center of the gear shaft holder 44 such that it projects inward.

Figure 18:
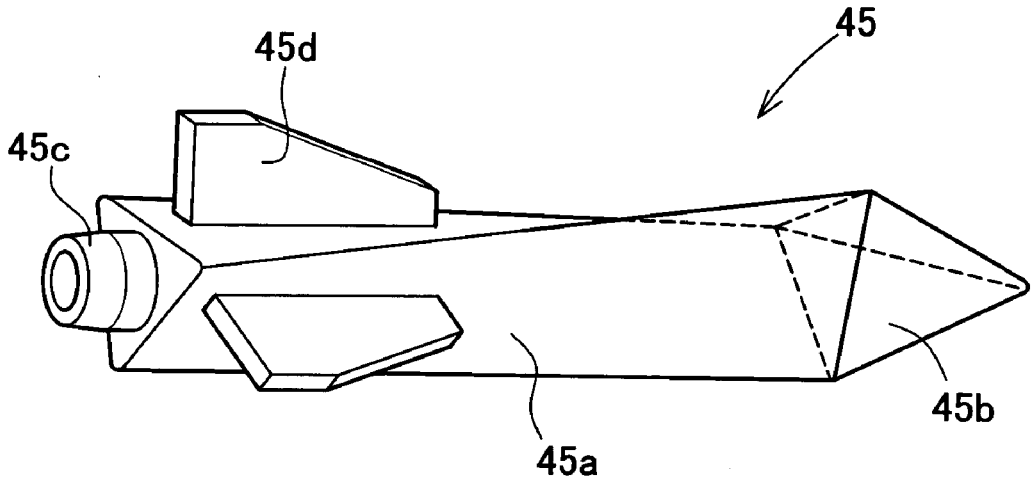
FIG. 18 is an oblique perspective view showing a shape of a joint directed to the third embodiment.

Further, the joint 45 has a twisted triangular prism main body 45*a* as shown in FIG. 18. The right end portion in the Figure is a pyramid shaped front edge section 45*b* and at the left end portion in the Figure, a cylindrical convex portion 45*c* is formed, to which the spring 46 is fit. A side projection 45*d* is formed on each of the three main body sections 45*a* near the cylindrical convex portion 45*c* with respect to the center. The front end of the side projection 45*d* is formed with a taper.

Further, as shown in FIG. 17, a spring 46 is disposed between the gear 43 and the joint 45. Consequently, the joint 45 is urged in the direction to the right side in the Figure. According to this embodiment, the non-twisted triangular prism hole 47 is formed in each of the joint holder section 43*a* of the gear 43 and the flange 32 of the image forming unit 30. When the image forming unit 30 is installed, the joint 45 makes contact with both the joint holder section 43*a* and the flange 32 through three points. As a result, the rotary driving force of the gear 43 is transmitted to the photosensitive body 21 by this joint 45.

In the connecting portion of this embodiment, the inside diameter of the fixing section 44*a* of the gear shaft holder 44 and the outside diameter of the fixing section 33*a* of the shaft holder 33 of the image forming unit 30 are formed to be substantially equal to each other. Because the fixing section 33*a* and the fixing section 44*a* are disposed so as to oppose each other, as shown in FIG. 17, when the image forming unit 30 is installed on the main body 2, the fixing section 33*a* is inserted into and fit to the inside peripheral side of the fixing section 44*a*. Therefore, the fixing section 44*a* and the fixing section 33*a* are fixed directly to each other, further the gear shaft holder 44 and the shaft holder 33 are fixed directly to each other. Here, the gear shaft holder 44 is fixed to the frame 42 of the main body 2. On the other hand, the shaft holder 33 is fixed to the housing 31 of the image forming unit 30. Consequently, the image forming unit 30 is positioned and fixed to the main body 2.

The color printer having the connecting portion of this embodiment as described in detail above, is capable of securing a rotation transmission accuracy between the input and output shafts even if no material having a large strength is used, without applying any stress to the holding portion when the input and output shafts deflect from each other, like the color printer 1 of the first embodiment.

Meanwhile, the present embodiment is a just mere exemplification, never restricting the present invention to any particular one. Therefore, naturally the present invention may be improved or modified in various ways within a range not departing from the gist. According to each of the respective embodiments, the joint 45 is substantially of triangular prism and the holes 47, 36*a* are provided in the joint holder section 43*a* and coupling 36 in which that joint is to be inserted. Instead, it is permissible to provide the joint holder section 43*a* and the coupling 36 with a substantially triangular prism convex portion and connect them through a joint having a hole on both end portions. Alternatively, it is permissible to provide the both end portions of the joint with a hole and a convex portion respectively.

Figure 19:
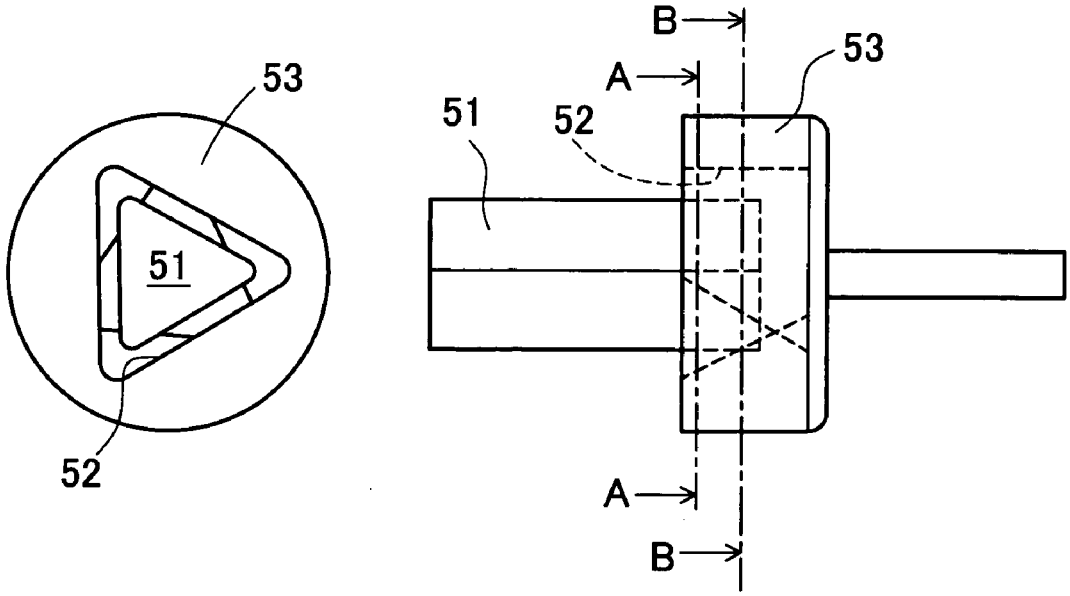
FIG. 19 is a diagram illustrating another example of a joint and a coupling directed to the third embodiment.
Figure 20:
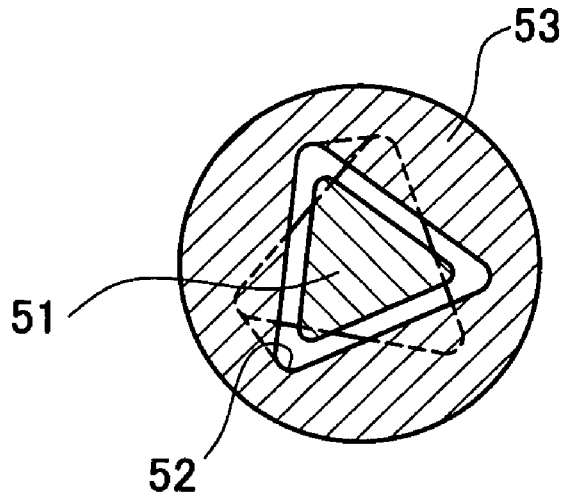
FIG. 20 is a sectional view showing still another example of a joint and a coupling directed to the third embodiment.
Figure 21:
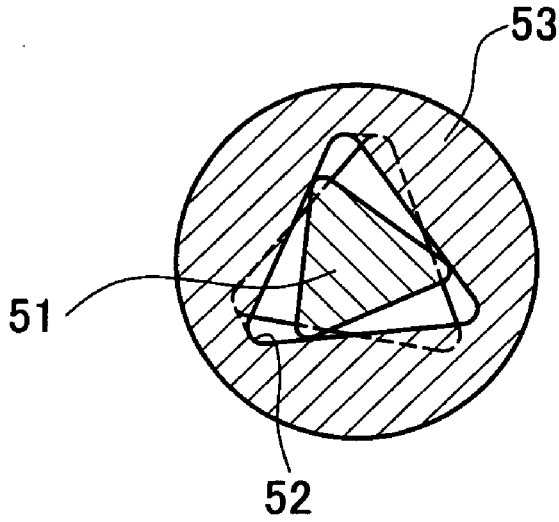
FIG. 21 is a sectional view showing still another example of a joint and a coupling directed to the third embodiment.

Although according to each of the above-described embodiments, it is stated that the joint 45 is twisted while the holes 36*a*, 47 are not twisted, the same effect is obtained even if these are inverted. FIG. 19 presents a side view and a front view indicating the condition in which the non-twisted triangular prism joint 15 is fit to the coupling 53 having the twisted triangular prism hole 52. FIG. 20 is a sectional view taken along the line A-A of FIG. 19 and FIG. 21 is a sectional view taken along the line B-B of FIG. 19. Under such condition also, each edge line of the joint 51 makes contact with the inner face of the hole 52 through a single point. Thus, even if the axes of the joint 51 and the hole 52 do not align, a rotary drive force is transmitted with this fitting condition. Alternatively, it is permissible that both the joint and hole are twisted while their twisting angles are different.

Figure 22:
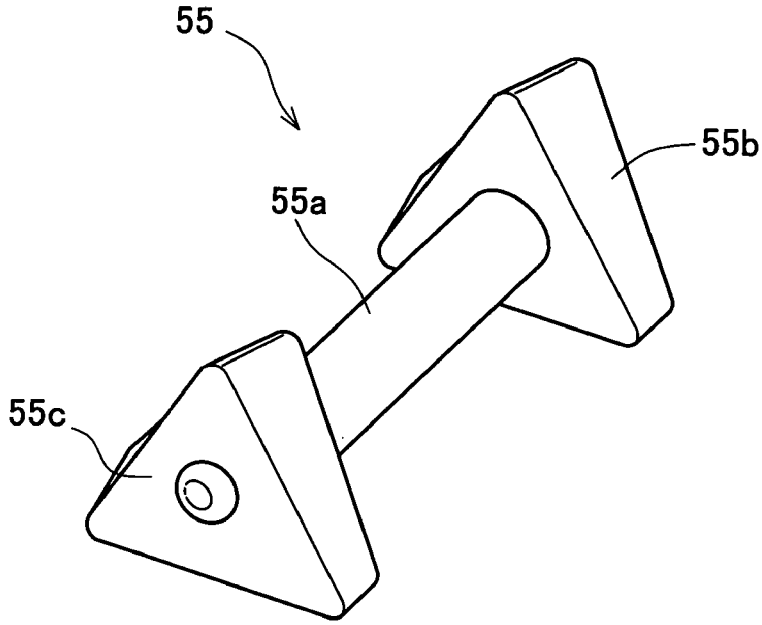
FIG. 22 is an oblique perspective view showing a shape of a joint directed to the third embodiment.

Instead of the joint 45 according to each embodiment, as shown in FIG. 22, it is permissible to use a composite joint 55 obtained by combining a plurality of members. The central portion 55*a* is preferred to be formed of material highly resistant to twisting and if it is formed in a narrow shape, it is preferable to employ metal or the like. Both end portions 55*b*, 55*c* are of twisted short triangular prism. In such a composite joint 55, it is possible to use different materials for each of the both end portions 55*b*, 55*c* or use the ones whose diameters or twisting angles are different.

Figure 23:
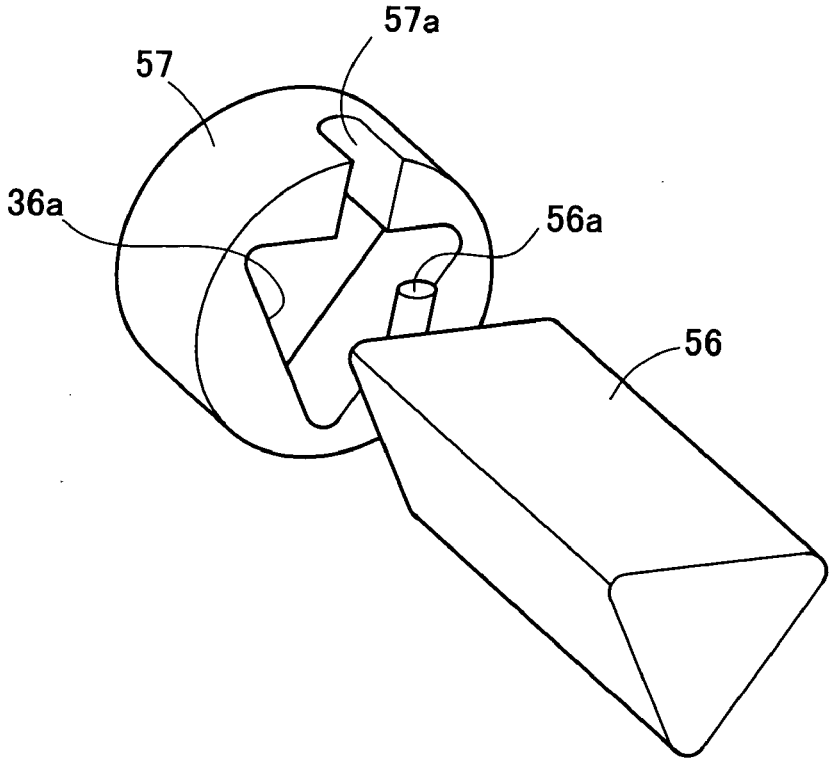
FIG. 23 is a diagram illustrating still another example of a joint and a coupling directed to the third embodiment.

Instead of the joint 45 according to each embodiment, it is permissible to use a joint 56 provided with an L-shaped protrusion 56*a* instead of the front edge section 45*b* as shown in FIG. 23. In this case, a coupling 57 in which the side having its protrusion 56*a* is provided with a cutout section 57*a* at an open end portion of the hole 36*a*. This cutout section 57*a* is wide enough for the protrusion 56*a*. As a result, the direction of the fitting of the joint 56 and the coupling 57 is specified. Because the joint and coupling are generally formed of resin integrally, the directivity defined at the forming time may appear as the characteristic of the components. If this joint 56 and coupling 57 are used, the directivity is prevented from changing when the image forming unit 30 is replaced.

According to the above-described embodiment, a removable process unit is the image forming unit 30 having the photosensitive body 21. However, the present invention is not restricted to this example, but this may be an intermediate image transfer belt unit. Further although according to the above-described embodiments, the present invention is applied to a color printer 1, the present invention is not restricted to these embodiments, but it may be applied to such an image forming unit as a monochrome printer, a copier and a facsimile.

What is claimed is:

1. An image forming apparatus for forming an image attached with a removable process unit, the image forming apparatus comprising:

a first driving force transmitting member for receiving rotary driving force to a process unit; and an intermediate driving force transmitting member for receiving rotary driving force from the first driving force transmitting member, the intermediate driving force transmitting member being arranged between the first driving force transmitting member and a process unit, wherein either the first driving force transmitting member or the intermediate driving force transmitting member has a concave section and the other driving force transmitting member has an end section located in the concave section, where a minimum diameter of the concave section is less than a diameter of the end section which is less than a maximum diameter of the concave section, the end section has three edge sections at its side section, contact members of which hardness is higher than the edge sections of the end section are arranged at portions on an inner surface of the concave section to make contact with the edge sections of the end section, the concave section has contact sections to be in contact with the edge sections at side section, number of the contact sections is three or a multiple of three, the edge sections and the contact sections have different twisting angles, and rotary driving force is transmitted from the intermediate driving force transmitting member to a process unit.

2. An image forming apparatus according to claim 1 further comprising an elastic member for urging the first driving force transmitting member and the intermediate driving force transmitting member to be separated from each other, wherein the concave section has a projecting section protruding inward from side section of the concave section, and the end section has a displacement stopper section to be in contact with the projecting section from back side.

3. An image forming apparatus according to claim 1, wherein the first driving force transmitting member has the concave section.

4. An image forming apparatus according to claim 1, wherein the concave section is not twisting and the end section is twisting.

5. An image forming apparatus comprising a main body and a process unit removable from the main body, forming an image attached a removable process unit to the main body, wherein the main body comprises a first driving force transmitting member for receiving rotary driving force to a process unit, the process unit comprises a second driving force transmitting member for receiving rotary driving force from the main body, either the main body or the process unit has an intermediate driving force transmitting member arranged between the first and the second driving force transmitting members, both a driving force transmitting portion between the first driving force transmitting member and the intermediate driving force transmitting member and a driving force transmitting portion between the intermediate driving force transmitting member and the second driving force transmitting member comprise a set of a concave section and an end section located in the concave section, the end section has three edge sections at its side section, the concave section has contact sections to be in contact with the edge sections at side section, number of the contact sections is three or a multiple of three, contact members of which hardness is higher than the edge sections of the end section are arranged at portions on an inner surface of the concave section to make contact with the edge sections of the end section, the edge sections and the contact sections have different twisting angles, and a minimum diameter of the concave section is less than a diameter of the end section which is less than a maximum diameter of the concave section.

6. An image forming apparatus according to claim 5, wherein both the first and the second driving force transmitting members have concave sections, the intermediate driving force transmitting member has end sections to be located in the concave sections at its both ends, the concave section of the first driving force transmitting member has a projecting section protruding inward from side section, the intermediate driving force transmitting section has a displacement stopper section to be in contact with the projecting section from back side, and the image forming apparatus comprises an elastic member for urging the first driving force transmitting member and the intermediate driving force transmitting member to be separated from each other.

7. An image forming apparatus according to claim 5, wherein the first driving force transmitting member has the concave section.

8. An image forming apparatus according to claim 5, wherein the concave section is not twisting and the end section is twisting.

9. An image forming apparatus for forming an image attached with a removable process unit, the image forming apparatus comprising:

a first driving force transmitting member for receiving rotary driving force to the process unit, the first driving force transmitting member having a concave section of polygon shaped cross section at its process unit side;

an intermediate driving force transmitting member of which one end portion is located in the concave section, the intermediate driving force transmitting member receiving rotary driving force from the first driving force transmitting member and transmitting rotary driving force to the process unit, and having a step section of polygon shaped cross section at its side surface;

a displacement stopper section arranged at the concave section and coming to contact with the step section when the intermediate driving force transmitting member escapes from the concave section; and a protection member inserted in the concave section and located between wall surface of the concave section and side surface of the intermediate driving force transmitting member, wherein the displacement stopper section is a part of the protection member.

10. An image forming apparatus according to claim 9, further comprising a fixer section for fixing outer surface of the protection member and wall surface of the concave section to each other.

11. An image forming apparatus according to claim 9, wherein the protection member is superior to the first driving force transmitting member and the intermediate driving force transmitting member with respect to abrasion durability.

12. An image forming apparatus comprising a main body and a process unit removable from the main body, forming an image attached a removable process unit to the main body, wherein the main body comprises a first driving force transmitting member for receiving rotary driving force to the process unit, the first driving force transmitting member having a concave section of polygon shaped cross section at its process unit side, the process unit comprises a second driving force transmitting member for receiving rotary driving force from the main body, the second driving force transmitting member having a concave section of polygon shaped cross section at its main body side, and either the main body or the process unit comprises:

an intermediate driving force transmitting member of which both ends are located in the concave sections of the first and the second driving force transmitting members, the intermediate driving force transmitting member receiving rotary driving force from the first driving force transmitting member, transmitting rotary driving force to the second driving force transmitting member, and having a step section of polygon shaped cross section at its side wall, and a displacement stopper section arranged at the concave section and coming to contact with the step section when the intermediate driving force transmitting member escapes from the concave section.

13. An image forming apparatus with a removable process unit comprising:

a driving member arranged rotatably within the image forming apparatus, the driving member being connected to driving source and having a polygon shape; and a driven member arranged within the removable process unit, the driven member having a concave section in which the driving member is inserted, the concave section having polygon shaped inner surface, wherein rotary driving force is transmitted by contact of edge lines of the driving member and inner surface of the concave section of the driven section, and the edge lines of the driving member and the inner surface of the concave section of the driven member have different twisted angles, and a minimum diameter of the concave section is less than a diameter of the end section which is less than a maximum diameter of the concave section;

and contact members of which hardness is higher than the driven member are arranged at portions on an inner surface of the concave section of the driven member to make contact with the edge lines of the driving member.

14. An image e forming apparatus according to claim 13 further comprising a transmitting member for transmitting driving force from the driving source to the driving member, wherein the transmitting member has a concave section of polygon shape at side of the driving member, transmits driving force to the driving member by contact of edge lines of the driving member and inner surface of the concave section of the transmitting member, and the edge lines of the driving member and the inner surface of the concave section of the transmitting member have different twisting angles.

15. An image forming apparatus according to claim 13, wherein the concave section is not twisting and the driving member is twisting.

16. An image forming apparatus with a removable process unit comprising:

a driving member arranged rotatably within the image forming apparatus, the driving member being connected to driving source and having a concave section of polygon shape at its end; and a driven member arranged within the removable process unit, being inserted in the concave section of the driving member, and having polygon shape, wherein rotary driving force is transmitted by contact of edge lines of the driven member and inner surface of the concave section of the driving section, and the edge lines of the driven member and the inner surface of the concave section of the driving member have different twisted angles, and a minimum diameter of the concave section is less than a diameter of the end section which is less than a maximum diameter of the concave section;

and contact members of which hardness is higher than the driven member are arranged at portions on an inner surface of the concave section of the driven member to make contact with the edge lines of the driving member.

17. An image forming apparatus according to claim 16, wherein the concave section is not twisting and the driving member is twisting.

* * * * *